US008044598B2

(12) United States Patent
Fukumoto et al.

(10) Patent No.: US 8,044,598 B2
(45) Date of Patent: Oct. 25, 2011

(54) LIGHT-EMITTING DEVICE

(75) Inventors: Ryota Fukumoto, Kanagawa (JP); Hiroyuki Miyake, Kanagawa (JP); Yoshifumi Tanada, Kanagawa (JP); Kei Takahashi, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 389 days.

(21) Appl. No.: 12/352,688

(22) Filed: Jan. 13, 2009

(65) Prior Publication Data

US 2009/0179572 A1 Jul. 16, 2009

(30) Foreign Application Priority Data

Jan. 15, 2008 (JP) ..... 2008-005148

(51) Int. Cl.
*G09G 3/10* (2006.01)

(52) U.S. Cl. ..... 315/169.3; 315/169.1; 345/77; 345/82

(58) Field of Classification Search ..... 315/169.1, 315/169.3; 345/55, 76–77, 82–83
See application file for complete search history.

(56) References Cited

U.S. PATENT DOCUMENTS 5,287,205 A 2/1994 Yamazaki et al.
5,568,288 A 10/1996 Yamazaki et al.
5,933,205 A 8/1999 Yamazaki et al.
5,963,278 A 10/1999 Yamazaki et al.
6,380,689 B1 4/2002 Okuda
6,436,815 B1 8/2002 Yamazaki et al.
6,437,367 B1 8/2002 Yamazaki et al.
6,738,034 B2 5/2004 Kaneko et al.
7,173,593 B2 2/2007 Matsumura et al.
7,180,245 B2 2/2007 Yamazaki et al.
7,218,294 B2 5/2007 Koyama et al.
7,221,343 B2 5/2007 Kageyama et al.
7,250,928 B2 7/2007 Yamazaki et al.
7,358,942 B2 4/2008 Yamazaki et al.
(Continued)

FOREIGN PATENT DOCUMENTS

JP 2005-37413 2/2005
(Continued)

OTHER PUBLICATIONS

International Search Report re application No. PCT/JP2009/050404, dated Apr. 7, 2009.

(Continued)

*Primary Examiner* — Anh Q Tran
(74) *Attorney, Agent, or Firm* — Husch Blackwell LLP

(57) ABSTRACT

The amplitude of a potential of a signal line is decreased and a scan line driver circuit is prevented from being excessively loaded. A light-emitting device includes a light-emitting element; a first power supply line having a first potential; a second power supply line having a second potential; a first transistor for controlling a connection between the first power supply line and the light-emitting element; a second transistor, which is controlled in accordance with a video signal, whether outputting the second potential applied from the second power supply line or not; a switching element for selecting either the first potential applied from the first power supply line or the output of the second transistor; and a third transistor for selecting whether the first potential or the output of the second transistor which is selected by the switch is applied to a gate of the first transistor.

19 Claims, 19 Drawing Sheets

U.S. PATENT DOCUMENTS

| | | | |
|---|---|---|---|
| 7,379,044 | B2 | 5/2008 | Kageyama et al. |
| 7,463,224 | B2 | 12/2008 | Sano |
| 7,755,581 | B2 | 7/2010 | Osame et al. |
| 2004/0263741 | A1 | 12/2004 | Koyama et al. |
| 2007/0177088 | A1 | 8/2007 | Koyama et al. |
| 2007/0236424 | A1 | 10/2007 | Kimura |

FOREIGN PATENT DOCUMENTS

| | | |
|---|---|---|
| JP | 2006-323371 | 11/2006 |
| JP | 2007-225652 | 9/2007 |
| JP | 2007-298973 | 11/2007 |
| WO | WO 2006/112421 A1 | 10/2006 |

OTHER PUBLICATIONS

Written Opinion re application No. PCT/JP2009/050404, dated Apr. 7, 2009.

Mizukami, M. et al, '36.1: 6-Bit Digital VGA OLED, SID Digest '00: SID Iinternational Symposium Digest of Technical Papers, 2000, vol. XXXI, pp. 912-915.

LIGHT-EMITTING DEVICE

TECHNICAL FIELD

The present invention relates to a light-emitting device using a light-emitting element.

BACKGROUND ART

Since light-emitting devices using light-emitting elements have high visibility, are suitable for reduction in thickness, and do not have limitations on viewing angle, they have attracted attention as display devices which are alternatives to CRTs (cathode ray tube) or liquid crystal display devices. There are a scan line driver circuit and a signal line driver circuit as typical examples of a driver circuit included in an active matrix light-emitting device. A plurality of pixels are selected every one line or every plurality of lines by a scan line driver circuit. Then, video signals are input to the pixels included in the selected line by a signal line driver circuit through a signal line.

In recent years, the number of pixels in an active matrix light-emitting device has been increased in order to display images with higher definition and higher resolution. Therefore, a scan line driver circuit and a signal line driver circuit need to be driven at high speed. In particular, while pixels in respective lines are selected by potentials which are applied from the scan line driver circuit to scan lines, the signal line driver circuit needs to input video signals to all of the pixels in the lines. Thus, the drive frequency of the signal line driver circuit is extremely higher than that of the scan line driver circuit, and there has been a problem in that power consumption is high due to the high drive frequency.

Reference 1 (Japanese Published Patent Application No. 2006-323371) discloses the structure of a light-emitting device in which the amplitude of video signals supplied to signal lines can be decreased and power consumption of a signal line driver circuit can be reduced.

DISCLOSURE OF INVENTION

General light-emitting devices include a transistor (a driving transistor) for controlling current supplied to a light-emitting element in each pixel. In order to supply current which is necessary for light emission to the light-emitting element, it is necessary to ensure a big potential difference between a pixel electrode and a common electrode of the light-emitting element. In addition, since a potential applied to the pixel electrode is applied from a power supply line through the driving transistor, amplitude which is large enough to control a potential difference between the pixel electrode and the common electrode normally is needed as the amplitude of a signal for controlling a gate of the driving transistor. In conventional light-emitting devices, this amplitude is supplied by signals from signal lines, and the amount of consumption current is large due to charging and discharging of the signal lines. However, in the light-emitting device disclosed in Reference 1, a potential applied to a gate of a driving transistor is controlled with a signal line when a potential difference is generated between a pixel electrode and a common electrode; and the potential applied to the gate of the driving transistor is controlled with a scan line when a potential difference is not generated between the pixel electrode and the common electrode. That is, a path for controlling the potential when the driving transistor is turned on and a path for controlling the potential when the driving transistor is turned off are varied from each other. Therefore, it is acceptable as long as signals input to the signal lines can control either the potential for turning on the driving transistor or the potential for turning off the driving transistor, so that the amplitude of the signals can be decreased. In other words, since the amplitude of the potentials of the signal lines that are frequently charged with electricity and discharged in a pixel portion can be decreased, power consumption of the signal line driver circuit can be reduced; consequently, power consumption of the whole light-emitting device can be reduced.

However, in the light-emitting device disclosed in Reference 1, not only selection of pixels in respective lines but also supply of electric charge to the gate of the driving transistor are performed using potentials applied from a scan line driver circuit to the scan lines. Therefore, an output portion of the scan line driver circuit for charging the scan lines with electricity or discharging the scan lines is heavily loaded. Thus, when the number of pixels which share one scan line is increased as the pixel portion has higher definition or when the length and resistance of the scan lines are increased as the screen becomes larger, the output portion of the scan line driver circuit is excessively loaded. Accordingly, there is a problem in that it is difficult to ensure the reliability of the scan line driver circuit or that it is difficult to operate the scan line driver circuit. In particular, such a problem is remarkable in a light-emitting device whose display portion exceeds 10 inches.

In view of the foregoing problems, the amplitude of a potential of a signal line is decreased and a scan line driver circuit is prevented from being excessively loaded.

As a path for applying a potential to a gate electrode of a driving transistor, paths are provided separately from a scan line to which a potential for selecting pixels in respective lines is applied from a scan line driver circuit and a signal line to which a potential of a video signal is applied from a signal line driver circuit. Specifically, a first potential for turning off the driving transistor and a second potential for turning on the driving transistor are applied to the gate electrode of the driving transistor included in a pixel. The first potential is applied to the gate electrode of the driving transistor from a first power supply line for applying a potential to a pixel electrode of a light-emitting element. Further, the second potential is applied to the gate electrode of the driving transistor from a second power supply line.

A light-emitting device in accordance with one aspect of the present invention includes a light-emitting element, a first power supply line having a first potential, a second power supply line having a second potential, a first transistor (a driving transistor) for controlling a connection between the first power supply line and the light-emitting element, a second transistor in which a signal in accordance with a video signal is input to a gate for controlling whether the second potential applied from the second power supply line is outputted, a switch for selecting either the first potential applied from the first power supply line or an output of the second transistor, and a third transistor for selecting whether either the first potential or the output of the second transistor which is selected by the switch is applied to a gate electrode of the first transistor.

A light-emitting device in accordance with another aspect of the present invention includes a light-emitting element, a first power supply line having a first potential, a second power supply line having a second potential, a first transistor (a driving transistor) for controlling a connection between the first power supply line and the light-emitting element, a second transistor in which a signal in accordance with a video signal is input to a gate for controlling whether the second potential applied from the second power supply line is outputted, a switch for selecting either the first potential applied from the first power supply line or an output of the second transistor, and a third transistor for selecting whether either the first potential or the output of the second transistor which is selected by the switch is applied to a gate electrode of the first transistor. The switch includes a fourth transistor for selecting the first potential applied from the first power supply and a fifth transistor which is connected to the second power supply line through the second transistor and provided for selecting the output of the second transistor.

In the present invention, as the path for applying a potential to the gate electrode of the driving transistor, paths are provided separately from a scan line and a signal line. Thus, the amplitude of a potential of the signal line can be decreased and a scan line driver circuit can be prevented from being excessively loaded. Accordingly, even if a pixel portion has a larger screen or higher definition, the reliability of the scan line driver circuit can be ensured; consequently, the reliability of the light-emitting device can be ensured. Further, power consumption of the whole light-emitting device can be reduced.

BEST MODE FOR CARRYING OUT THE INVENTION

Hereinafter, embodiment modes and embodiments will be described with reference to the drawings. Note that modes illustrated in this specification can be implemented in various different ways and it will be readily appreciated by those skilled in the art that various changes and modifications are possible without departing from the spirit and the scope of the modes illustrated in this specification. Therefore, the present invention should not be construed as being limited to the following description of the embodiment modes and embodiments.

Embodiment Mode 1

Figure 1:
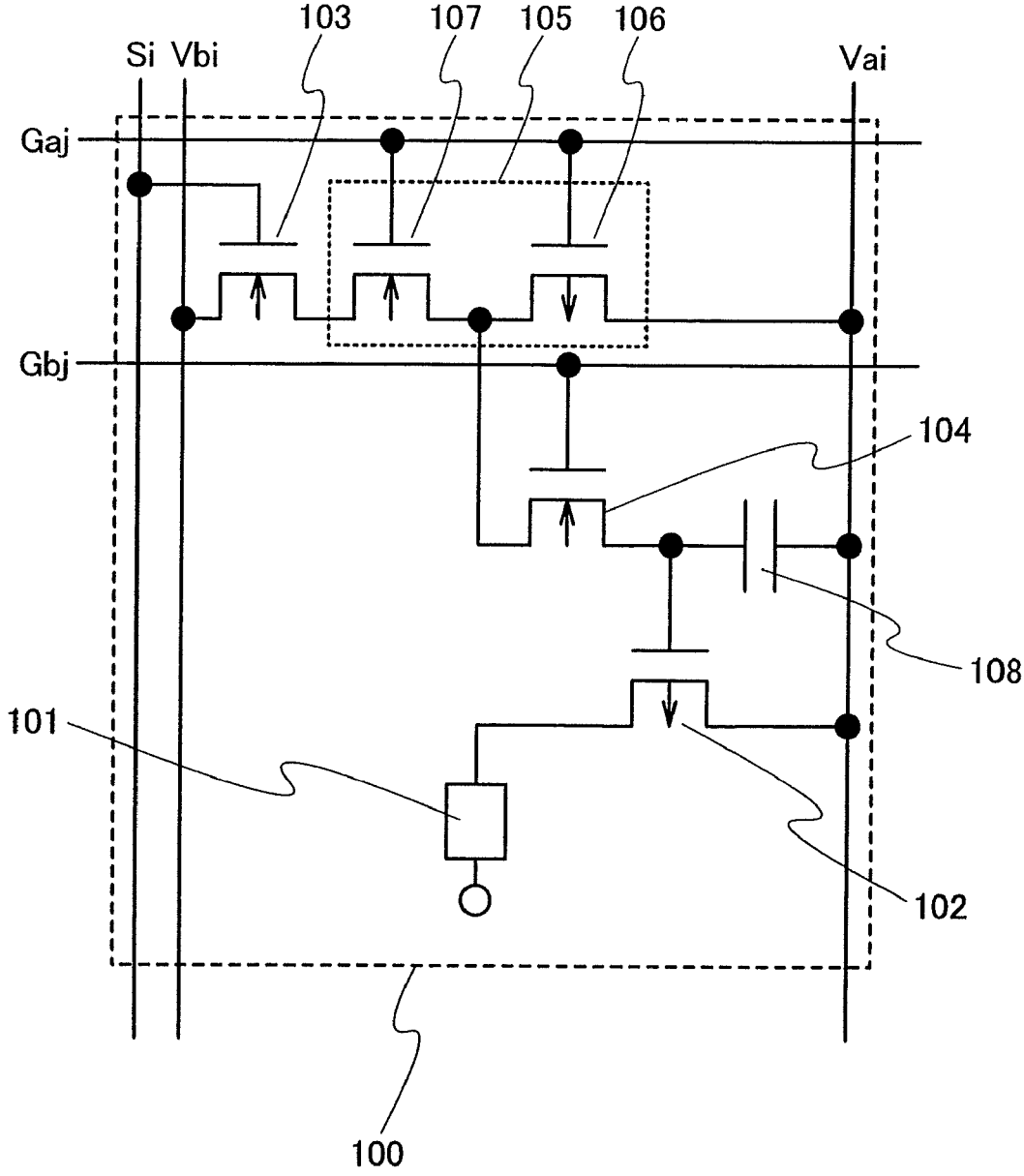
FIG. 1 is a circuit diagram of a pixel included in a light-emitting device.

In this embodiment mode, the structure of a pixel included in a light-emitting device that is one mode illustrated in this specification is described. FIG. 1 shows a circuit diagram of a pixel included in the light-emitting device that is one mode illustrated in this specification as an example. A pixel 100 shown in FIG. 1 includes at least a light-emitting element 101, a first power supply line Vai (i is any one of 1 to x) having a first potential, a second power supply line Vbi (i is any one of 1 to x) having a second potential, a first transistor 102, a second transistor 103, a third transistor 104, and a switch 105.

The light-emitting element 101 includes a pixel electrode, a common electrode, and an electroluminescent layer to which current is supplied through the pixel electrode and the common electrode. A connection between the first power supply line Vai and the pixel electrode of the light-emitting element 101 is controlled by the first transistor 102. Note that a connection refers to conduction, i.e., electrical connection. In FIG. 1, one of a source region and a drain region of the first transistor 102 is connected to the first power supply line Vai; and the other of the source region and the drain region of the first transistor 102 is connected to the pixel electrode of the light-emitting element 101. A potential difference is generated between the common electrode of the light-emitting element 101 and the first power supply line Vai; and by turning on the first transistor 102, it is possible to supply current generated by the potential difference to the light-emitting element 101.

In addition, the switching of the second transistor 103 is controlled in accordance with a potential of a video signal supplied to a gate electrode of the second transistor 103. When the second transistor 103 is off, an output of the second transistor 103 is high-impedance state. And, when the second transistor 103 is turned on, the second transistor 103 outputs the second potential of the second power supply line Vbi to the switch 105. In FIG. 1, the pixel 100 includes a signal line Si (i is any one of 1 to x); and the signal line Si is connected to the gate electrode of the second transistor 103. Video signals output from a signal line driver circuit are supplied to the gate electrode of the second transistor 103 through the signal line Si. Further, in FIG. 1, one of a source region and a drain region of the second transistor 103 is connected to the second power supply line Vbi; and the other of the source region and the drain region of the second transistor 103 is connected to the switch 105.

The first potential is applied to the switch 105 from the first power supply line Vai. In addition, the second potential is applied to the switch 105 from the second power supply line Vbi through the second transistor 103. The switch 105 selects either the first potential or the second potential which is applied and outputs the selected potential. In FIG. 1, an example is shown in which the switch 105 includes a fourth transistor 106 and a fifth transistor 107.

In addition, in FIG. 1, one of a source region and a drain region of the fourth transistor 106 is connected to the first power supply line Vai; and the other of the source region and the drain region of the fourth transistor 106 is connected to one of a source region and a drain region of the third transistor 104. Further, one of a source region and a drain region of the fifth transistor 107 is connected to the other of the source region and the drain region of the second transistor 103; and the other of the source region and the drain region of the fifth transistor 107 is connected to the one of the source region and the drain region of the third transistor 104.

When one of the fourth transistor 106 and the fifth transistor 107 is on, the other of the fourth transistor 106 and the fifth transistor 107 is off. In FIG. 1, the pixel 100 includes a first scan line Gaj (j is any one of 1 to y). In addition, the fourth transistor 106 is a p-channel transistor; the fifth transistor 107 is an n-channel transistor; and both a gate electrode of the fourth transistor 106 and a gate electrode of the fifth transistor 107 are connected to the first scan line Gaj. Note that in the case where both the gate electrode of the fourth transistor 106 and the gate electrode of the fifth transistor 107 are connected to the first scan line Gaj, it is acceptable as long as the fourth transistor 106 and the fifth transistor 107 have opposite polarity to each other. In the case where the fourth transistor 106 and the fifth transistor 107 have the same polarity, the gate electrode of the fourth transistor 106 and the gate electrode of the fifth transistor 107 are connected to different scan lines from each other.

The third transistor 104 selects whether to apply the first potential or the second potential output from the switch 105 to a gate electrode of the first transistor 102. Thus, when the third transistor 104 is on, the first potential or the second potential is applied to the gate electrode of the first transistor 102. On the other hand, when the third transistor 104 is off, the potential of the gate electrode of the first transistor 102 is held.

In FIG. 1, the pixel 100 includes a second scan line Gbj (j is any one of 1 to y); and a gate electrode of the third transistor 104 is connected to the second scan line Gbj. In addition, the other of the source region and the drain region of the third transistor 104 is connected to the gate electrode of the first transistor 102.

In addition, in FIG. 1, the pixel 100 includes a storage capacitor 108. One of electrodes of the storage capacitor 108 is connected to the gate electrode of the first transistor 102; and the other of the electrodes of the storage capacitor 108 is connected to the first power supply line Vai. Note that although the storage capacitor 108 is provided in order to hold voltage (gate voltage) between the gate electrode and the source region of the first transistor 102, it is not necessary to provide the storage capacitor 108 if the gate voltage can be held without using the storage capacitor 108, for example, if the gate capacitance of the first transistor 102 is large.

Figure 2:
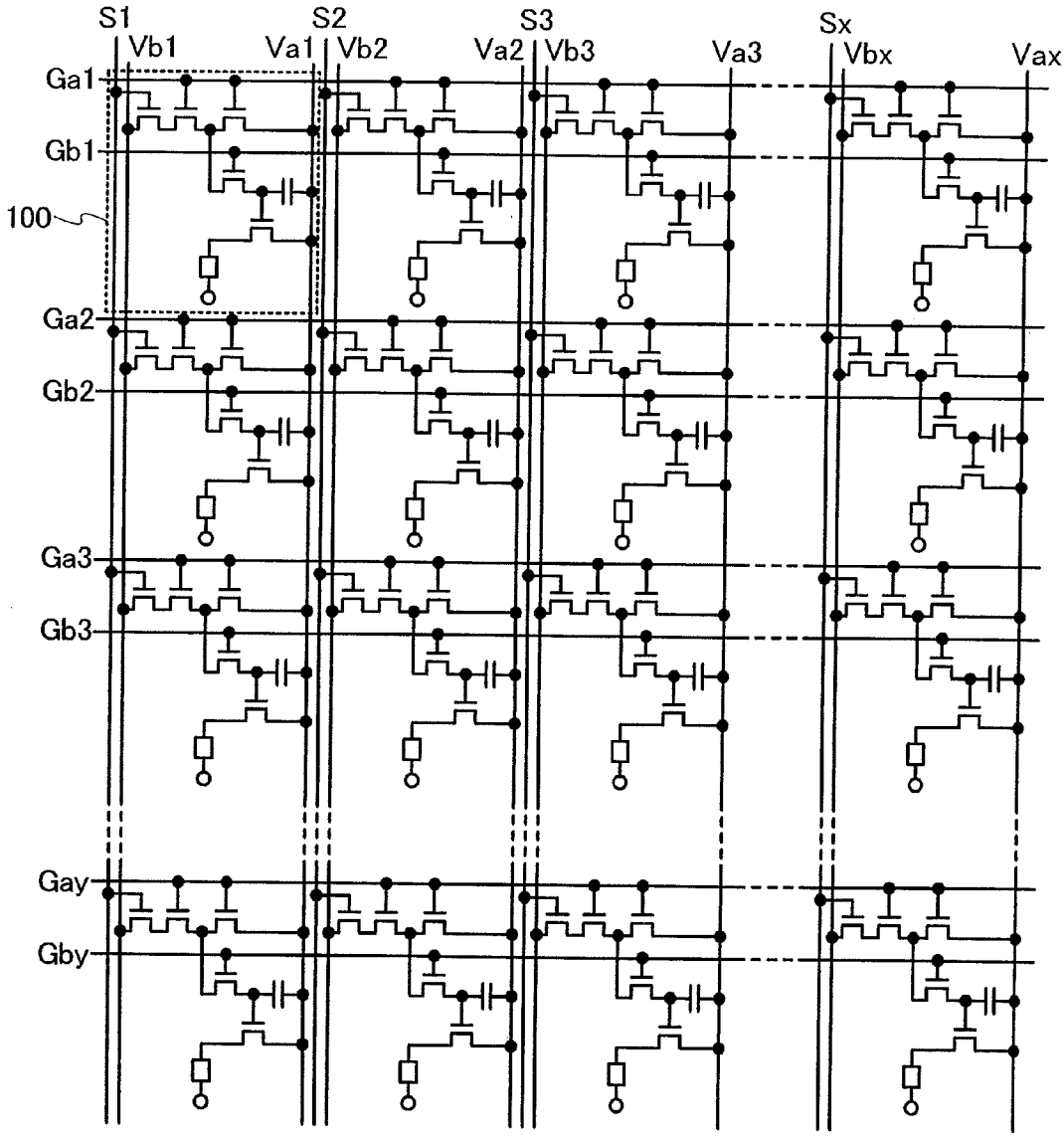
FIG. 2 is a circuit diagram of a pixel portion included in the light-emitting device.

Further, although the case in which the first transistor 102 is a p-channel transistor, the second transistor 103 is an n-channel transistor, and the third transistor 104 is an n-channel transistor is shown in FIG. 1, the polarity of the transistors can be selected as appropriate by a designer FIG. 2 shows a circuit diagram of the whole pixel portion where a plurality of the pixels 100 shown in FIG. 1 are provided. In the pixel portion shown in FIG. 2, pixels of one line, which share the first scan line Gaj U is any one of 1 to y), also share the second scan line Gbj (j is any one of 1 to y). In addition, the pixels of the one line include signal lines Si (i is any one of 1 to x) which are different from each other.

Next, the specific operation of the light-emitting device that is one mode illustrated in this specification is described. In the one mode illustrated in this specification, the operation of the light-emitting device can be described with the whole operation divided into at least three periods: a reset period, a selection period, and a display period. A reset period corresponds to a period during which the gate voltage of the first transistor 102 is reset to a predetermined value. A selection period corresponds to a period during which the gate voltage of the first transistor 102 is set in accordance with a video signal. A display period correspond to a period during which current in accordance with the set gate voltage is supplied to the light-emitting element 101. In addition to the three periods, an erase period during which the first transistor 102 is turned off so that the light emission of the light-emitting element 101 is forcibly stopped may be provided.

Figure 3A:
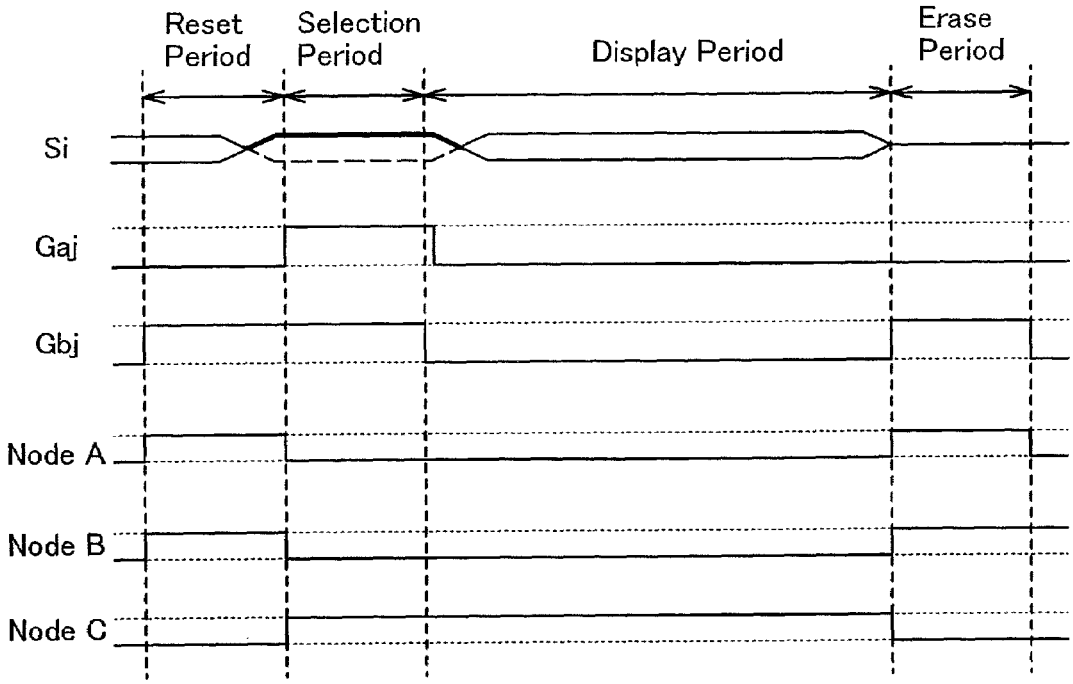
FIGS. 3A and 3B are timing charts each illustrating timing of driving the light-emitting device.
Figure 3B:
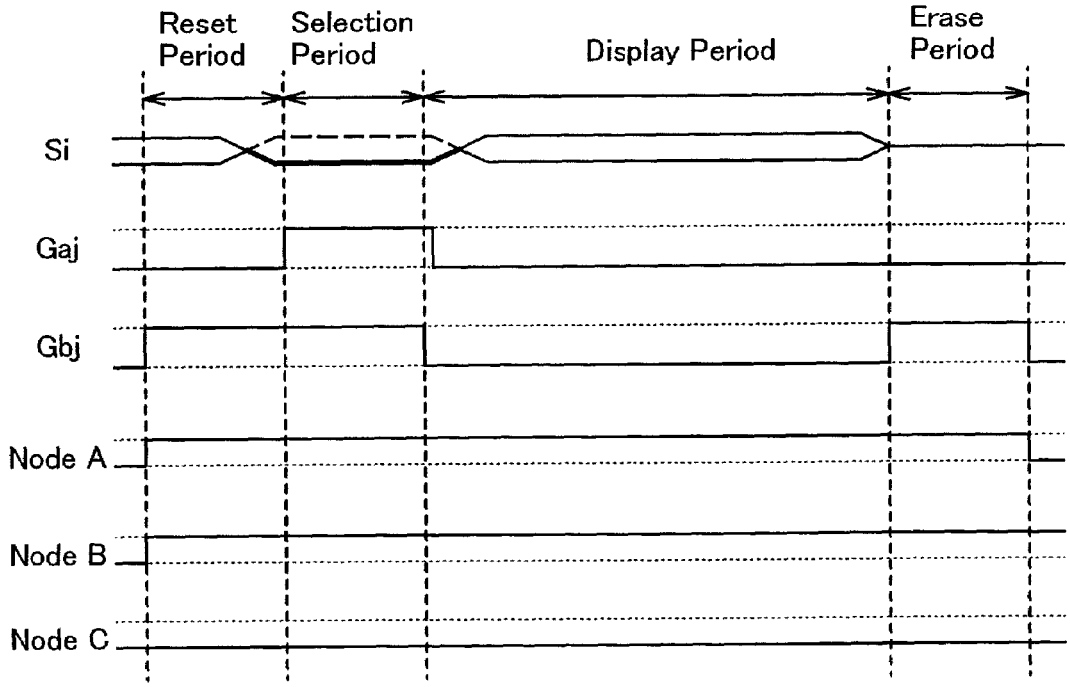

Timing charts of the signal line Si, the first scan line Gaj, and the second scan line Gbj in the reset period, the selection period, the display period, and the erase period of the light-emitting device shown in FIG. 1 and FIG. 2 are shown in FIGS. 3A and 3B as examples. FIG. 3A is a timing chart in the case where the light-emitting element 101 emits light in accordance with a video signal. FIG. 3B is a timing chart in the case where the light-emitting element 101 does not emit light in accordance with a video signal. In addition, the one of the source region and the drain region of the third transistor 104 is denoted by a node A; the gate electrode of the first transistor 102 is denoted by a node B; and the pixel electrode of the light-emitting element 101 is denoted by a node C. Timing charts of potentials thereof are also shown in FIGS. 3A and 3B.

Figure 4:
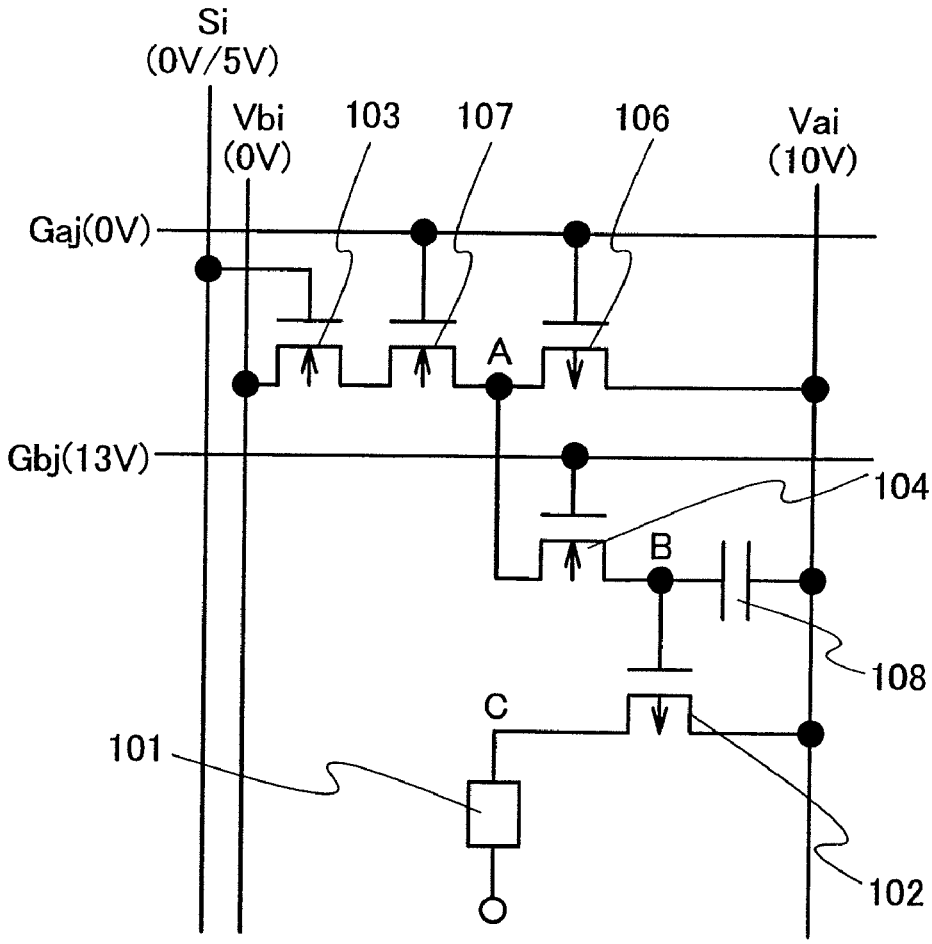
FIG. 4 is a circuit diagram illustrating the operation of the pixel included in the light-emitting device.
Figure 5A:
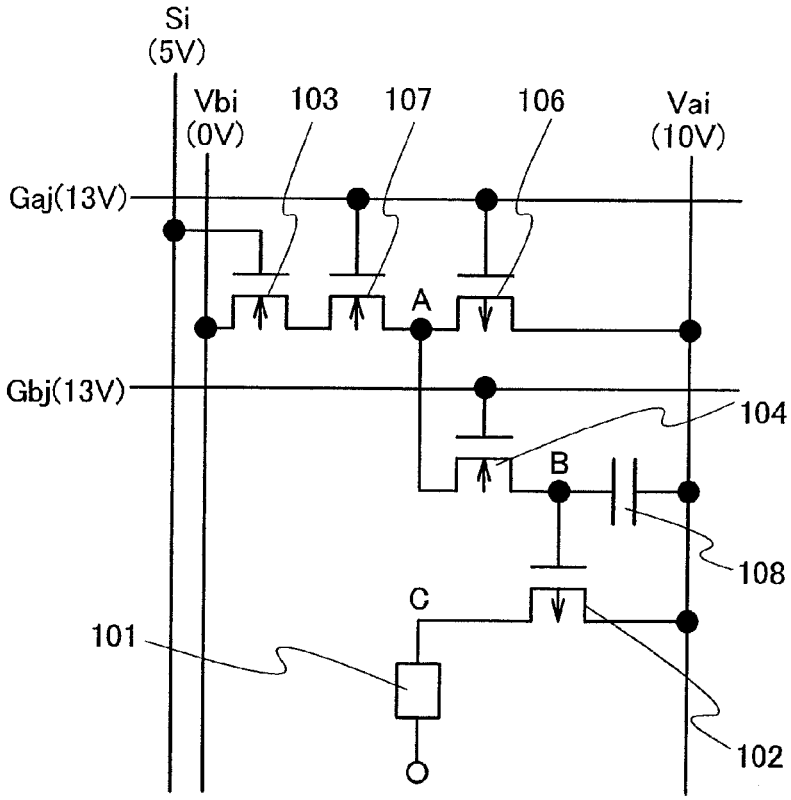
FIGS. 5A and 5B are circuit diagrams each illustrating the operation of the pixel included in the light-emitting device.
Figure 5B:
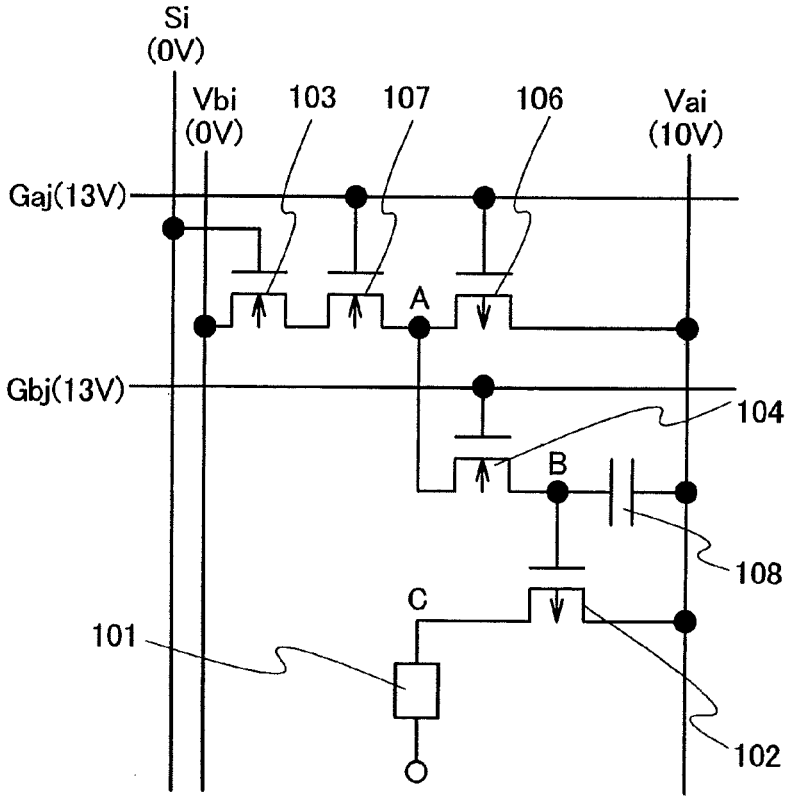
Figure 6A:
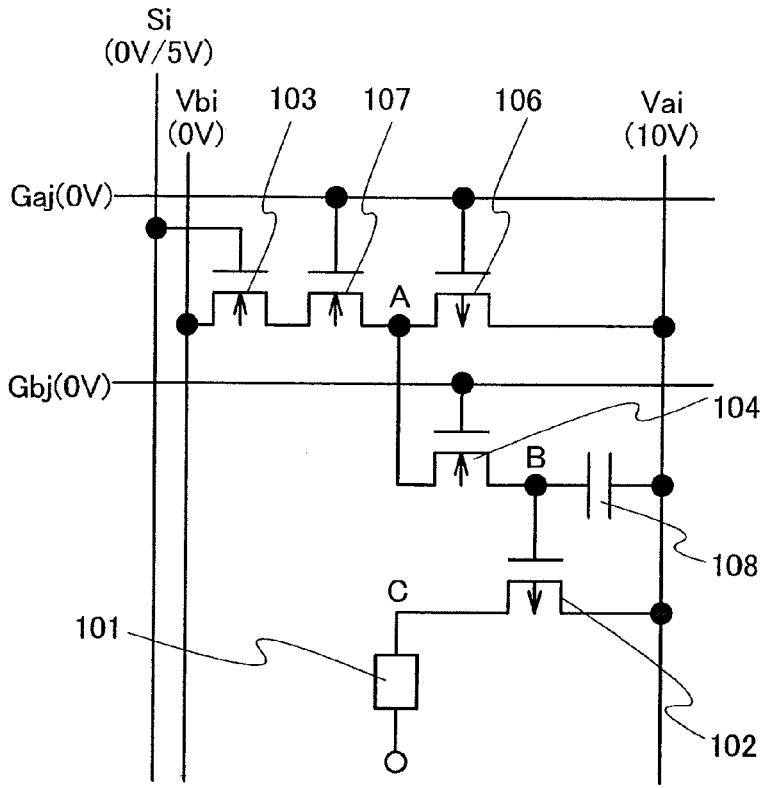
FIGS. 6A and 6B are circuit diagrams each illustrating the operation of the pixel included in the light-emitting device.
Figure 6B:
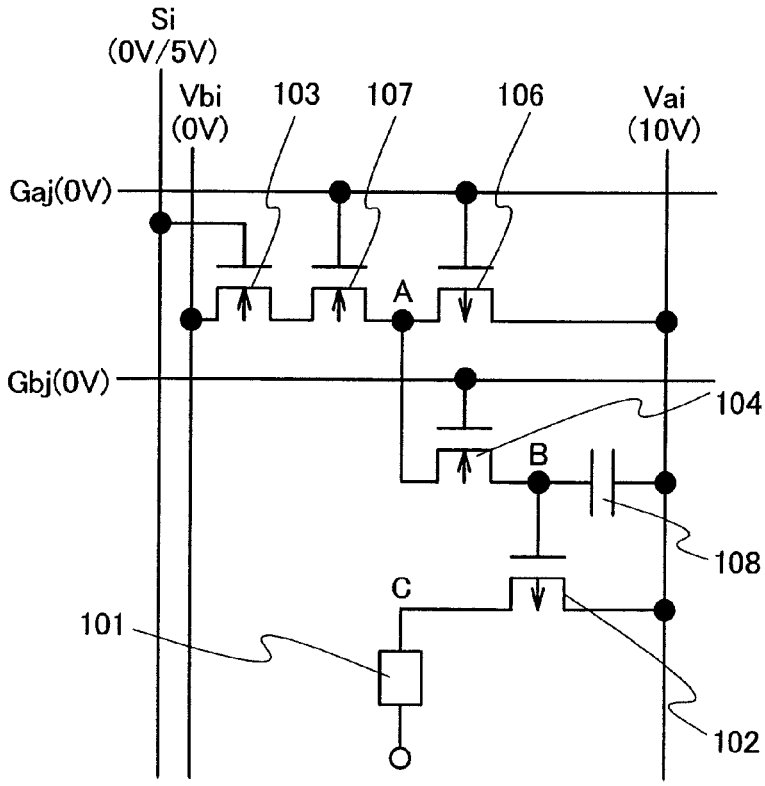
Figure 7:
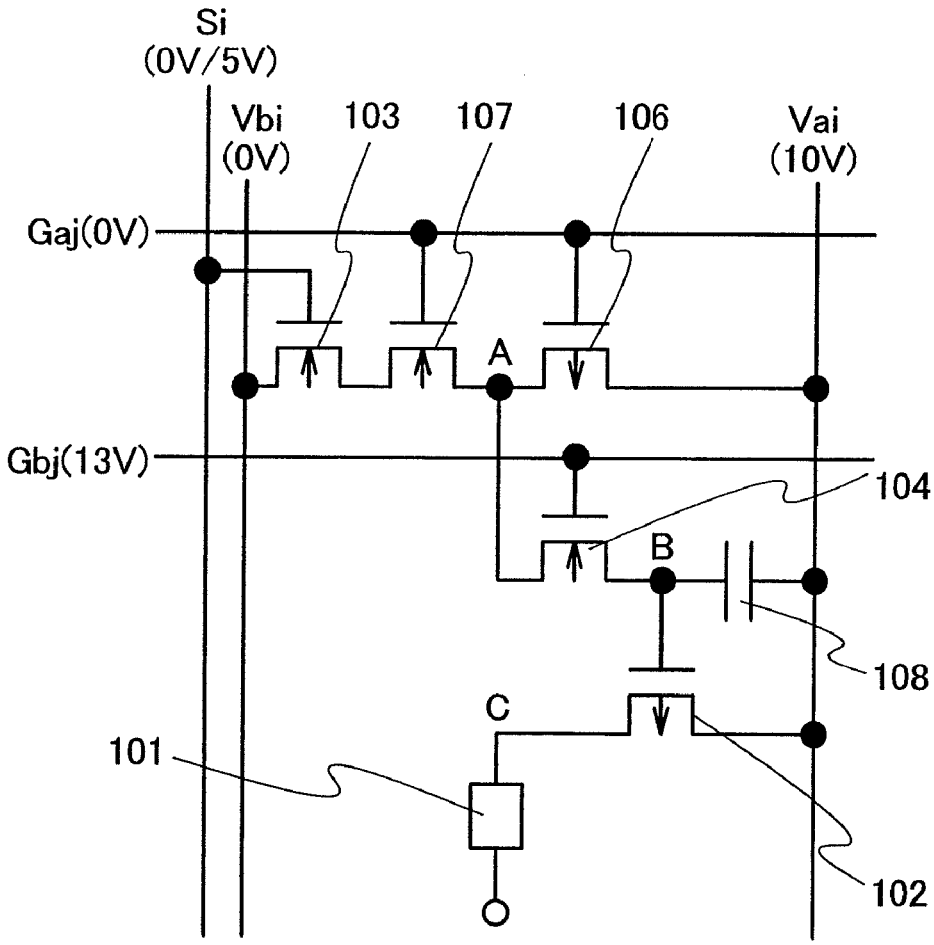
FIG. 7 is a circuit diagram illustrating the operation of the pixel included in the light-emitting device.

FIG. 4 shows a circuit diagram illustrating an operating condition of each transistor in the reset period. FIGS. 5A and 5B show circuit diagrams each illustrating an operating condition of each transistor in the selection period. FIGS. 6A and 6B show circuit diagrams each illustrating an operating condition of each transistor in the display period. FIG. 7 shows a circuit diagram illustrating an operating condition of each transistor in the erase period.

In FIGS. 3A and 3B, FIG. 4, FIGS. 5A and 5B, FIGS. 6A and 6B, and FIG. 7, a high-level potential of a video signal, which is applied to the signal line Si, is 5 V; and a low-level potential of the video signal, which is applied to the signal line Si, is 0 V. A potential of the first power supply line Vai is 10 V A potential of the second power supply line Vbi is 0 V. In addition, each of high-level potentials of the first scan line Gaj and the second scan line Gbj is 13 V; and each of low-level potentials of the first scan line Gaj and the second scan line Gbj is 0 V. Further, a potential of the common electrode of the light-emitting element 101 is 0 V. Note that the levels of the potentials applied to the signal line Si, the first power supply line Vai, the second power supply line Vbi, the first scan line Gaj, and the second scan line Gbj are not limited to the above levels. The levels thereof may be set to optimal levels as appropriate depending on the threshold voltage and the polarity of each transistor included in the pixel, whether the pixel electrode of the light-emitting element 101 corresponds to an anode or a cathode, the structure and the composition of the electroluminescent layer, or the like.

First, in the reset period, a potential for turning on the fourth transistor 106 and turning off the fifth transistor 107 is applied to the first scan line Gaj. In FIGS. 3A and 3B and FIG. 4, a low-level potential (0 V) is applied to the first scan line Gaj. In addition, in the reset period, a potential for turning on the third transistor 104 is applied to the second scan line Gbj. In FIGS. 3A and 3B and FIG. 4, a high-level potential (13 V) is applied to the second scan line Gbj. Thus, the potential (10 V) of the first power supply line Vai is applied to the gate electrode of the first transistor 102 through the fourth transistor 106 and the third transistor 104. Since the voltage between the gate electrode and the source region of the first transistor 102 is the same or substantially the same as 0 V and is lower than the threshold voltage, the first transistor 102 is turned off.

Next, in the selection period, a potential for turning off the fourth transistor 106 and turning on the fifth transistor 107 is applied to the first scan line Gaj. In FIGS. 3A and 3B and FIGS. 5A and 5B, a high-level potential (13 V) is applied to the first scan line Gaj. In addition, in the selection period, a potential for turning on the third transistor 104 is applied to the second scan line Gbj. In FIGS. 3A and 3B and FIGS. 5A and 5B, a high-level potential (13 V) is applied to the second scan line Gbj.

In addition, in the selection period, a potential of a video signal is applied to the gate electrode of the second transistor 103. In FIG. 5A, a high-level potential (5 V) of the video signal is applied to the signal line Si. Thus, the second transistor 103 is turned on, and the potential (0 V) of the second power supply line Vbi is applied to the gate electrode of the first transistor 102 through the second transistor 103, the fifth transistor 107, and the third transistor 104. Accordingly, since the first transistor 102 is turned on, current flows between the pixel electrode and the common electrode of the light-emitting element 101, so that the light-emitting element 101 emits light.

In FIG. 5B, a low-level potential (0 V) of the video signal is applied to the signal line Si. Thus, the second transistor 103 is turned off, and the potential applied to the gate electrode of the first transistor 102 in the reset period is also held in the selection period. Accordingly, the first transistor 102 is kept off, so that the light-emitting element 101 does not emit light.

Next, in the display period, a potential for turning on the fourth transistor 106 and turning off the fifth transistor 107 is applied to the first scan line Gaj. In FIGS. 3A and 3B and FIGS. 6A and 6B, a low-level potential (0 V) is applied to the first scan line Gaj. In addition, in the display period, a potential for turning off the third transistor 104 is applied to the second scan line Gbj. In FIGS. 3A and 3B and FIGS. 6A and 6B, a low-level potential (0 V) is applied to the second scan line Gbj. Thus, the potential applied to the gate electrode of the first transistor 102 in the selection period is also held in the display period.

Therefore, in the case where the first transistor 102 is on in the selection period as shown in FIG. 5A, the first transistor 102 is kept on in the display period as shown in FIG. 6A, so that the light-emitting element 101 emits light. Alternatively, in the case where the first transistor 102 is off in the selection period as shown in FIG. 5B, the first transistor 102 is kept off in the display period as shown in FIG. 6B, so that the light-emitting element 101 does not emit light.

Note that although the reset period may be provided again next to the display period, the case where the erase period is provided between the display period and the reset period is described in this embodiment mode.

Next, in the erase period, a potential for turning on the fourth transistor 106 and turning off the fifth transistor 107 is applied to the first scan line Gaj. In FIGS. 3A and 3B and FIG. 7, a low-level potential (0 V) is applied to the first scan line Gaj. In addition, in the erase period, a potential for turning on the third transistor 104 is applied to the second scan line Gbj. In FIGS. 3A and 3B and FIG. 7, a high-level potential (13 V) is applied to the second scan line Gbj. Thus, the potential (10 V) of the first power supply line Vai is applied to the gate electrode of the first transistor 102 through the fourth transistor 106 and the third transistor 104. Since the voltage between the gate electrode and the source region of the first transistor 102 is the same or substantially the same as 0 V and is lower than the threshold voltage, the first transistor 102 is turned off.

Note that in the light-emitting device that is one mode illustrated in this specification, video signals which are input to a pixel are digital video signals, so that the pixel is set into a light-emitting state or a non-light-emitting state in accordance with the switching of on and off of the first transistor 102. Thus, grayscale can be displayed using an area ratio grayscale method or a time ratio grayscale method. An area ratio grayscale method refers to a driving method by which one pixel is divided into a plurality of subpixels and the respective subpixels are driven separately based on video signals so that grayscale is displayed. Further, a time ratio grayscale method refers to a driving method by which a period during which a pixel is in a light-emitting state is controlled so that grayscale is displayed.

Since the response time of light-emitting elements is shorter than that of liquid crystal elements or the like, the light-emitting elements are suitable for a time ratio grayscale method. Specifically, in the case of performing display with a time ratio grayscale method, one frame period is divided into a plurality of subframe periods. Then, in accordance with video signals, the light-emitting element in the pixel is set in a light-emitting state or a non-light-emitting state in each subframe period. With the above structure, the total length of a period during which the pixel is actually in a light-emitting state in one frame period can be controlled with the video signals, so that grayscale can be displayed.

In the light-emitting device that is one mode illustrated in this specification, at least a reset period, a selection period, and a display period are provided in each subframe period. After the display period in each subframe period, an erase period may be provided.

Note that in a time ratio grayscale method, since it is necessary to write video signals to pixels in each subframe period, the number of charging and discharging of signal lines is larger than that of an area ratio grayscale method. However, in the light-emitting device that is one mode illustrated in this specification, since the amplitude of potentials of the signal lines can be decreased, power consumption of the signal line driver circuit and power consumption of the whole light-emitting device can be reduced even if the number of charging and discharging is increased.

Further, in the time ratio grayscale method, when the number of subframe periods is increased in order to increase gray levels, the length of each subframe period is shortened if the length of one frame period is fixed. In the light-emitting device that is one mode illustrated in this specification, during a period (a pixel portion selection period) after the selection period is started in a first pixel in the pixel portion until the selection period is finished in the last pixel, the erase period is sequentially started from a pixel in which the selection period is finished first, so that the light-emitting element can be forcibly made not to emit light. Thus, the drive frequency of a driver circuit is suppressed and the length of the subframe period is made shorter than that of the pixel portion selection period, so that gray levels can be increased.

Figure 8:
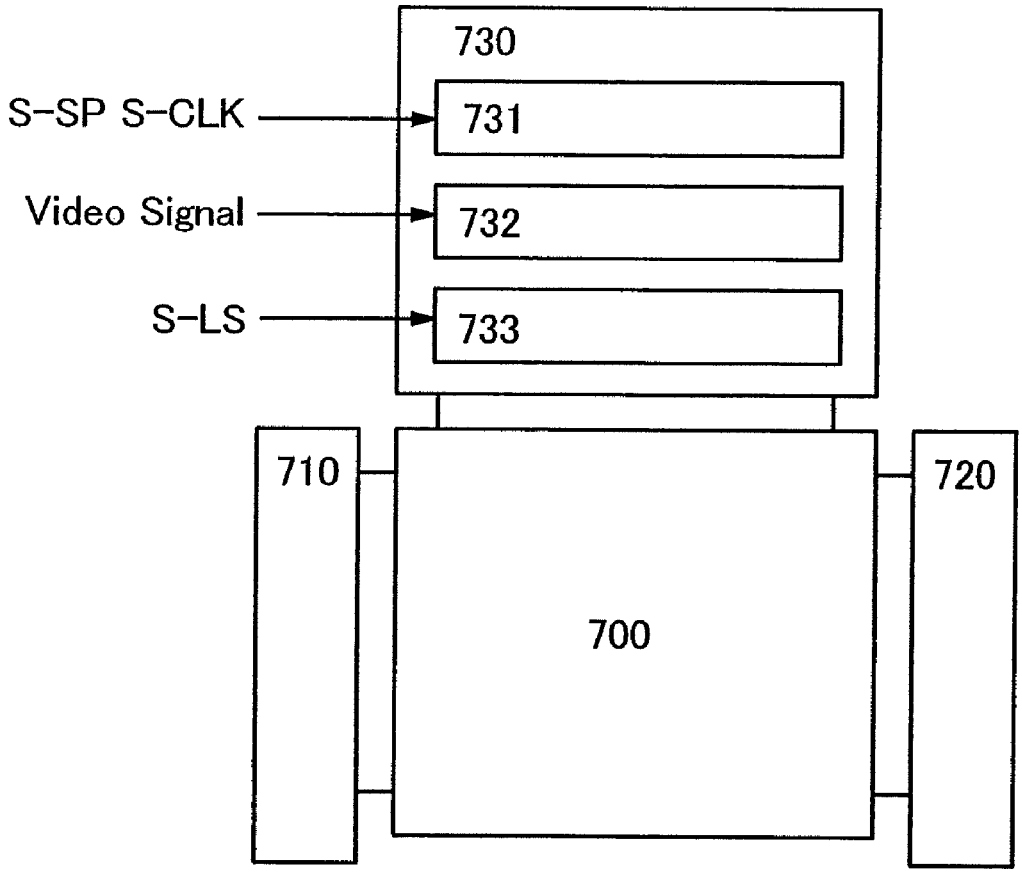
FIG. 8 is a block diagram of the light-emitting device.

Next, the general structure of the light-emitting device that is one mode illustrated in this specification is described. In FIG. 8, a block diagram of the light-emitting device that is one mode illustrated in this specification is shown as an example.

The light-emitting device shown in FIG. 8 includes a pixel portion 700 having a plurality of pixels provided with light-emitting elements, a scan line driver circuit 710 for controlling the operation of a switching element included in each pixel by controlling a potential of a first scan line, a scan line driver circuit 720 for controlling the switching of a third transistor included in each pixel by controlling a potential of a second scan line, and a signal line driver circuit 730 for controlling the input of video signals to the pixels.

In FIG. 8, the signal line driver circuit 730 includes a shift register 731, a first memory circuit 732, and a second memory circuit 733. A clock signal S-CLK and a start pulse signal S-SP are input to the shift register 731. The shift register 731 generates timing signals, pulses of which are sequentially shifted, in accordance with the clock signal S-CLK and the start pulse signal S-SP, and outputs the timing signals to the first memory circuit 732. The order of the appearance of the pulses of the timing signal may be switched in accordance with scan direction switching signals.

When a timing signal is input to the first memory circuit 732, video signals are sequentially written to and held in the first memory circuit 732 in accordance with the pulse of the timing signal. Note that the video signals may be sequentially written to a plurality of memory elements included in the first memory circuit 732. Further, so-called division driving may be performed, in which the memory elements included in the first memory circuit 732 are divided into several groups and video signals are input to each group in parallel. Note that the number of groups in this case is referred to as the number of divisions. For example, when the memory elements are divided into groups each having four memory elements, division driving is performed with four divisions.

The time until video signal writing to all of the memory elements of the first memory circuit 732 is completed is referred to as a line period. In practice, a line period refers to a period when a horizontal retrace interval is added to the line period in some cases.

When one line period is finished, the video signals held in the first memory circuit 732 are written to the second memory circuit 733 all at once and held in accordance with the pulse of a signal S-LS which is input to the second memory circuit 733. Video signals in the next line period are sequentially written to the first memory circuit 732 which has finished sending the video signals to the second memory circuit 733, in accordance with timing signals from the shift register 731 again. During this second round of one line period, the video signals which are written to and held in the second memory circuit 733 are input to the respective pixels in the pixel portion 700 through signal lines.

Note that in the signal line driver circuit 730, a circuit which can output signals, pulses of which are sequentially shifted, may be used instead of the shift register 731.

Note that although the pixel portion 700 is directly connected to the second memory circuit 733 in the next stage in FIG. 8, one mode illustrated in this specification is not limited to this structure. A circuit which performs signal processing on the video signals output from the second memory circuit 733 can be provided in the previous stage of the pixel portion 700. Examples of a circuit which performs signal processing are a buffer which can shape a waveform, and the like.

Next, the structure of the scan line driver circuit 710 and the scan line driver circuit 720 is described. Each of the scan line driver circuit 710 and the scan line driver circuit 720 includes circuits such as a shift register, a level shifter, and a buffer. Each of the scan line driver circuit 710 and the scan line driver circuit 720 generates signals having the waveforms shown in the timing charts in FIGS. 3A and 3B. By inputting the generated signals to the first scan line or the second scan line, each of the scan line driver circuit 710 and the scan line driver circuit 720 controls the operation of the switching element in each pixel or the switching of the third transistor.

Note that in the light-emitting device shown in FIG. 8, an example is shown in which the scan line driver circuit 710 generates signals which are input to the first scan line and the scan line driver circuit 720 generates signals which are input to the second scan line; however, one scan line driver circuit may generate both signals which are input to the first scan line and signals which are input to the second scan line. In addition, for example, there is a possibility that a plurality of the first scan lines used for controlling the operation of the switching element be provided in each pixel depending on the number of transistors included in the switching element and the polarity of each transistor included in the switching element. In that case, one scan line driver circuit may generate all signals that are input to the plurality of first scan lines; or a plurality of signal lines may generate all signals that are input to the plurality of first scan lines, as shown in the scan line driver circuit 710 and the scan line driver circuit 720 shown in FIG. 8.

Note that although the pixel portion 700, the scan line driver circuit 710, the scan line driver circuit 720, and the signal line driver circuit 730 can be provided over the same substrate, any of them can be provided over a different substrate.

Embodiment Mode 2

Next, a method for manufacturing a light-emitting device that is one mode illustrated in this specification is described in detail. Note that although a thin film transistor (TFT) is shown as an example of a semiconductor element in this embodiment mode, a semiconductor element used for the light-emitting device that is one mode illustrated in this specification is not limited to this. For example, a memory element, a diode, a resistor, a capacitor, an inductor, or the like can be used instead of a TFT.

Figure 9A:
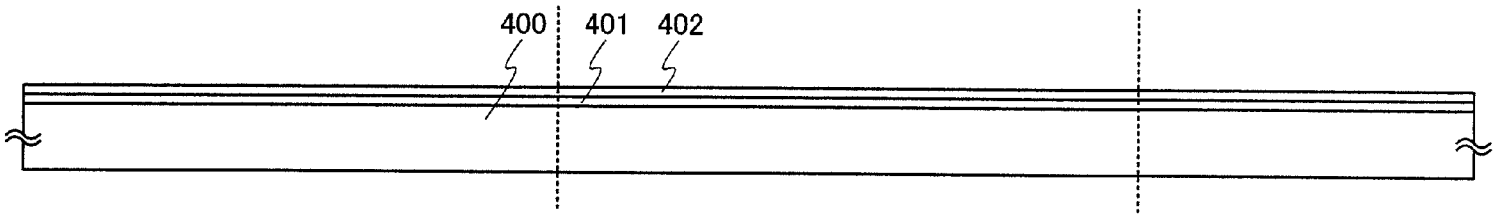
FIGS. 9A to 9C are cross-sectional views illustrating a method for manufacturing a light-emitting device.

First, as shown in FIG. 9A, an insulating film 401 and a semiconductor film 402 are sequentially formed over a substrate 400 having heat resistance. It is possible to form the insulating film 401 and the semiconductor film 402 successively.

A glass substrate such as a barium borosilicate glass substrate or an aluminoborosilicate glass substrate, a quartz substrate, a ceramic substrate, or the like can be used as the substrate 400. Alternatively, a metal substrate such as a stainless steel substrate with the surface provided with an insulating film, or a silicon substrate with the surface provided with an insulating film may be used. There is a tendency that a flexible substrate formed using a synthetic resin such as plastics generally has a lower allowable temperature limit than the above substrates; however, such a substrate can be used as long as it can withstand processing temperature in manufacturing steps.

As a plastic substrate, polyester typified by polyethylene terephthalate (PET), polyethersulfone (PES), polyethylene naphthalate (PEN), polycarbonate (PC), nylon, polyetheretherketone (PEEK), polysulfone (PSF), polyetherimide (PEI), polyarylate (PAR), polybutylene terephthalate (PBT), polyimide, an acrylonitrile butadiene styrene resin, polyvinyl chloride, polypropylene, polyvinyl acetate, an acrylic resin, or the like can be used.

The insulating film 401 is provided in order that alkaline earth metal or alkali metal such as Na contained in the substrate 400 can be prevented from being diffused into the semiconductor film 402 and adversely affecting characteristics of a semiconductor element such as a transistor. Thus, the insulating film 401 is formed using silicon nitride, silicon nitride oxide, or the like which can suppress diffusion of alkali metal or alkaline earth metal into the semiconductor film 402. Note that in the case of using a substrate containing even a small amount of alkali metal or alkaline earth metal, such as a glass substrate, a stainless steel substrate, or a plastic substrate, it is effective to provide the insulating film 401 between the substrate 400 and the semiconductor film 402 from the viewpoint of preventing diffusion of impurities.

However, when a substrate in which diffusion of impurities does not lead to a significant problem, such as a quartz substrate, is used as the substrate 400, the insulating film 401 is not necessarily provided.

The insulating film 401 is formed using an insulating material such as silicon oxide, silicon nitride (e.g., $SiN_x$ or $Si_3N_4$), silicon oxynitride ($SiO_xN_y$) (x>y>0), or silicon nitride oxide ($SiN_xO_y$) (x>y>0) by CVD, sputtering, or the like.

The insulating film 401 can be formed using either a single insulating film or by stacking a plurality of insulating films. In this embodiment mode, the insulating film 401 is formed by sequentially stacking a silicon oxynitride film having a thickness of 100 nm, a silicon nitride oxide film having a thickness of 50 nm, and a silicon oxynitride film having a thickness of 100 nm. However, the material and the thickness of each film, and the number of stacked layers are not limited to them. For example, instead of the silicon oxynitride film formed in the lower layer, a siloxane-based resin having a thickness greater than or equal to 0.5 μm and less than or equal to 3 μm may be formed by a spin coating method, a slit coating method, a droplet discharge method, a printing method, or the like. In addition, instead of the silicon nitride oxide film formed in the middle layer, a silicon nitride (e.g., $SiN_x$ or $Si_3N_4$) film may be used. Further, instead of the silicon oxynitride film formed in the upper layer, a silicon oxide film may be used. The thickness of each film is preferably greater than or equal to 0.05 μm and less than or equal to 3 μm and can be freely selected within this range.

The silicon oxide film can be formed using a mixed gas of silane and oxygen, TEOS (tetraethoxysilane) and oxygen, or the like by a method such as thermal CVD, plasma enhanced CVD, atmospheric pressure CVD, or bias ECRCVD. Further, typically, the silicon nitride film can be formed using a mixed gas of silane and ammonia by plasma enhanced CVD. Furthermore, typically, the silicon oxynitride film and the silicon nitride oxide film can be formed using a mixed gas of silane and dinitrogen monoxide by plasma enhanced CVD.

The semiconductor film 402 is preferably formed without being exposed to the air after forming the insulating film 401. The thickness of the semiconductor film 402 is greater than or equal to 20 nm and less than or equal to 200 nm (preferably greater than or equal to 40 nm and less than or equal to 170 nm, more preferably greater than or equal to 50 nm and less than or equal to 150 nm). Note that the semiconductor film 402 may be formed using either an amorphous semiconductor or a polycrystalline semiconductor. In addition, as the semiconductor, silicon germanium as well as silicon can be used. In the case of using silicon germanium, the concentration of germanium is preferably about 0.01 to 4.5 atomic percent.

Note that the semiconductor film 402 may be crystallized by a known technique. As a known crystallization method, there are a laser crystallization method with laser light and a crystallization method with a catalytic element. Alternatively, it is possible to combine a crystallization method with a catalytic element and a laser crystallization method. In addition, in the case where a substrate having high heat resistance, such as a quartz substrate, is used as the substrate 400, any of the following crystallization methods may be combined: a thermal crystallization method with an electrically heated oven, a lamp annealing crystallization method with infrared light, a crystallization method with a catalytic element, and high temperature annealing at about 950° C.

For example, in the case of using laser crystallization, in order to increase the resistance of the semiconductor film 402 with respect to laser, heat treatment at 550° C. for 4 hours is performed on the semiconductor film 402 before laser crystallization. Then, by irradiating the semiconductor film 402 with laser light of second to fourth harmonics of the fundamental wave by using a solid-state laser capable of continuous oscillation, crystals with large grain size can be obtained. For example, typically, a second (532 nm) or third (355 nm) harmonic of an Nd:$YVO_4$ laser (having a fundamental wave of 1064 nm) is preferably used. Specifically, laser light emitted from the continuous wave $YVO_4$ laser is converted into a harmonic by a non-linear optical element to obtain laser light having an output of 10 W. Then, it is preferable to shape the laser light into a rectangular or elliptical shape on an irradiation surface by an optical system so that the semiconductor film 402 is irradiated with the laser light. In this case, an energy density of about 0.01 to 100 MW/cm$^2$ (preferably 0.1 to 10 MW/cm$^2$) is needed. Then, irradiation is performed with a scanning speed of about 10 to 2000 cm/sec.

As a continuous wave gas laser, an Ar laser, a Kr laser, or the like can be used. In addition, as a continuous wave solid-state laser, a YAG laser, a $YVO_4$ laser, a YLF laser, a $YAlO_3$ laser, a forsterite ($Mg_2SiO_4$) laser, a $GdVO_4$ laser, a $Y_2O_3$ laser, a glass laser, a ruby laser, an alexandrite laser, a Ti:sapphire laser, or the like can be used.

Further, as a pulsed laser, an Ar laser, a Kr laser, an excimer laser, a $CO_2$ laser, a YAG laser, a $Y_2O_3$ laser, a $YVO_4$ laser, a YLF laser, a $YAlO_3$ laser, a glass laser, a ruby laser, an alexandrite laser, a Ti:sapphire laser, a copper vapor laser, or a gold vapor laser can be used, for example.

The laser crystallization may be performed by pulsed laser light at a repetition rate greater than or equal to 10 MHz, which is a significantly higher frequency band than a generally used frequency band of several tens to several hundreds of hertz. It is said that the time between the irradiation of the semiconductor film 402 with the pulsed laser light and complete solidification of the semiconductor film 402 is several tens to several hundreds of nanoseconds. Thus, by using the above frequency band, the semiconductor film 402 can be irradiated with laser light of the next pulse after the semiconductor film 402 is melted by the laser light and before the semiconductor film 402 is solidified. Therefore, a solid-liquid interface can be continuously moved in the semiconductor film 402, so that the semiconductor film 402 having crystal grains which continuously grow toward a scanning direction is formed. Specifically, an aggregation of crystal grains each having a width of 10 to 30 μm in the scanning direction of the crystal grains and a width of about 1 to 5 μm in a direction perpendicular to the scanning direction can be formed. By forming such crystal grains of single crystal grown continuously in the scanning direction, the semiconductor film 402 having few grain boundaries at least in a channel direction of the TFT can be formed.

Note that the laser crystallization may be performed by irradiation with a fundamental wave of continuous wave laser light and a harmonic of continuous wave laser light in parallel. Alternatively, the laser crystallization may be performed by irradiation with a fundamental wave of continuous wave laser light and a harmonic of pulsed laser light in parallel.

Note that the laser irradiation may be performed in an atmosphere of an inert gas such as a rare gas or a nitrogen gas. Thus, roughness of a semiconductor surface due to laser light irradiation can be prevented, and variation in threshold voltage due to variation in interface state density can be suppressed.

By the above laser light irradiation, the semiconductor film 402 with higher crystallinity is formed. Note that a polycrystalline semiconductor which is formed in advance by sputtering, plasma enhanced CVD, thermal CVD, or the like may be used for the semiconductor film 402.

Although the semiconductor film 402 is crystallized in this embodiment mode, the semiconductor film 402 may remain as an amorphous silicon film or a microcrystalline semiconductor film without being crystallized and may be subjected to a process described below. A TFT formed using an amorphous semiconductor or a microcrystalline semiconductor has advantages of low cost and high yield because the number of manufacturing steps is smaller than that of a TFT using a polycrystalline semiconductor.

An amorphous semiconductor can be obtained by glow discharge decomposition of a gas containing silicon. Examples of a gas containing silicon are $SiH_4$, $Si_2H_6$, and the like. The gas containing silicon may be diluted with hydrogen or hydrogen and helium.

Next, channel doping by which an impurity element which imparts p-type conductivity or an impurity element which imparts n-type conductivity is added at a low concentration is performed on the semiconductor film 402. The channel doping may be performed on the whole semiconductor film 402 or may be selectively performed on part of the semiconductor film 402. As an impurity element which imparts p-type conductivity, boron (B), aluminum (Al), gallium (Ga), or the like can be used. As an impurity element which imparts n-type conductivity, phosphorus (P), arsenic (As), or the like can be used. Here, boron (B) is used as the impurity element and is added so that it is contained at a concentration greater than or equal to $1\times10^{16}/cm^3$ and less than or equal to $5\times10^{17}/cm^3$.

Figure 9B:
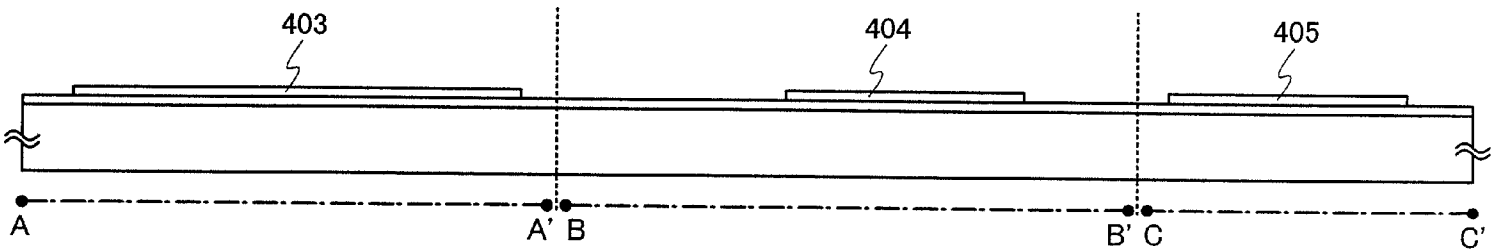
Figure 12:
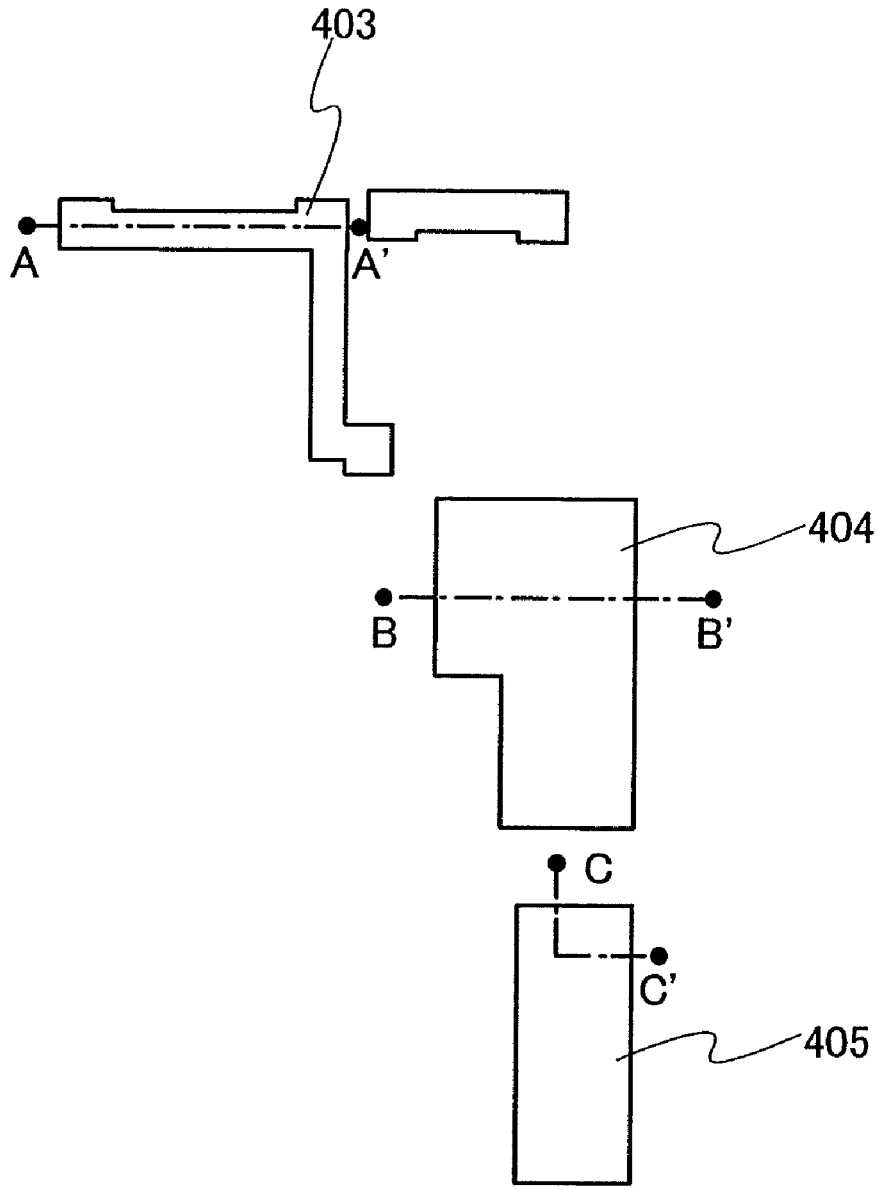
FIG. 12 is a top view illustrating a method for manufacturing the light-emitting device.

Next, as shown in FIG. 9B, the semiconductor film 402 is processed (patterned) into a desired shape to form a semiconductor film 403, a semiconductor film 404, and a semiconductor film 405 which have island shapes. FIG. 12 corresponds to a top view of a pixel in which the semiconductor film 403, the semiconductor film 404, and the semiconductor film 405 are formed. FIG. 9B shows a cross-sectional view taken along broken line A-A' in FIG. 12, a cross-sectional view taken along broken line B-B' in FIG. 12, and a cross-sectional view taken along broken line C-C' in FIG. 12.

Figure 9C:
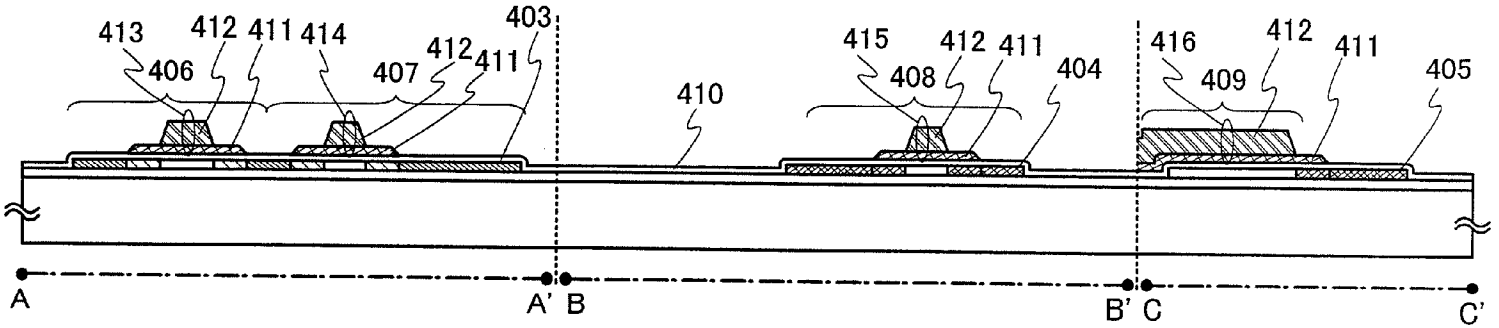

Then, as shown in FIG. 9C, a transistor 406, a transistor 407, a transistor 408, and a storage capacitor 409 are formed using the semiconductor film 403, the semiconductor film 404, and the semiconductor film 405.

Specifically, a gate insulating film 410 is formed so as to cover the semiconductor film 403, the semiconductor film 404, and the semiconductor film 405. Then, over the gate insulating film 410, a plurality of conductive films 411 and 412 which are processed (patterned) into desired shapes are formed. A pair of the conductive films 411 and a pair of the conductive films 412 which overlap with the semiconductor film 403 function as a gate electrode 413 of the transistor 406 and a gate electrode 414 of the transistor 407. The conductive films 411 and 412 which overlap with the semiconductor film 404 function as a gate electrode 415 of the transistor 408. Further, the conductive films 411 and 412 which overlap with the semiconductor film 405 function as an electrode 416 of the storage capacitor 409.

Then, impurities which impart n-type or p-type conductivity are added to the semiconductor film 403, the semiconductor film 404, and the semiconductor film 405 by using the conductive films 411, the conductive films 412, or a resist which is deposited and patterned, as a mask, so that source regions, drain regions, and LDD regions, and the like are formed. Note that here, the transistors 406 and 407 are n-channel transistors and the transistor 408 is a p-channel transistor.

Figure 13:
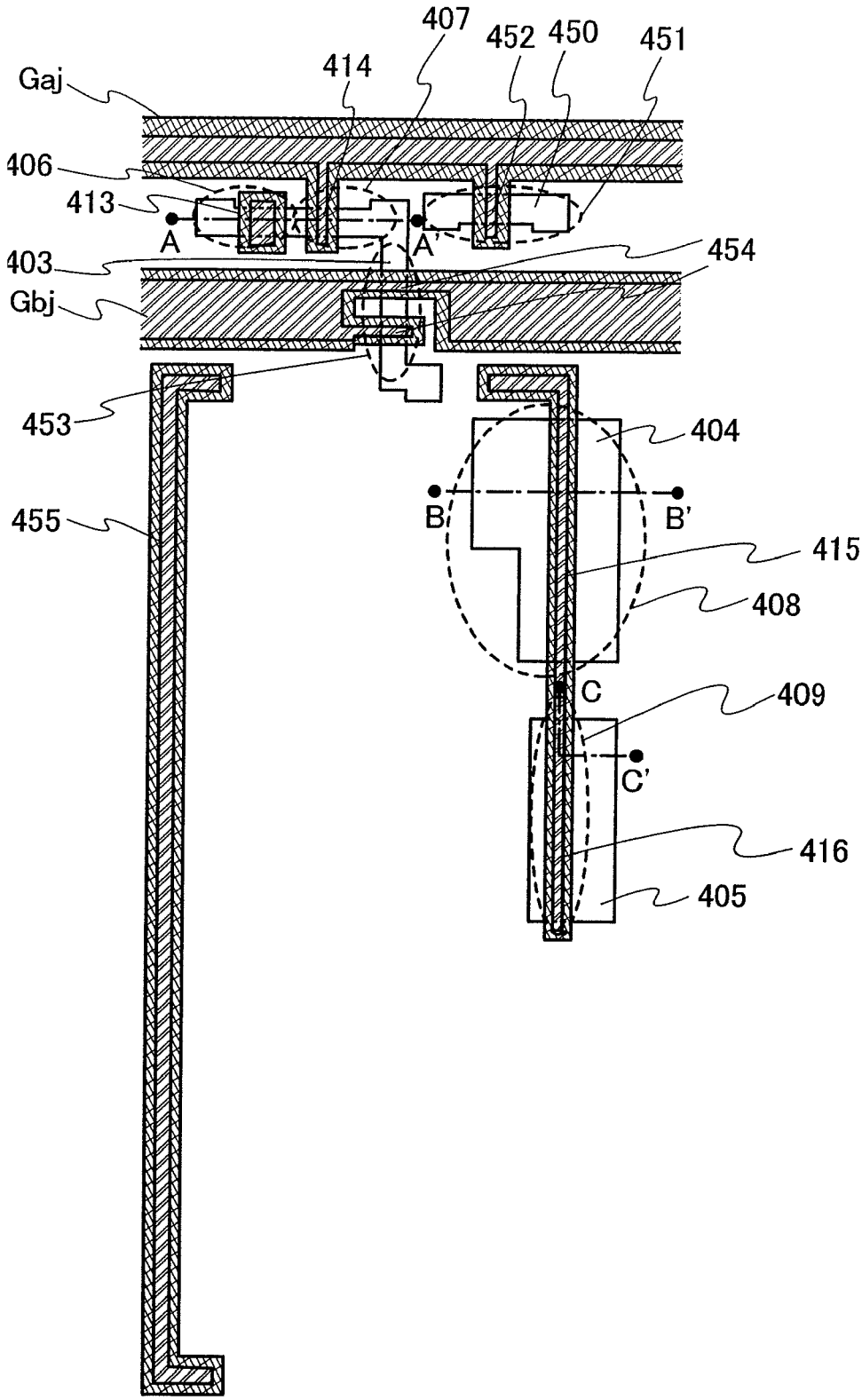
FIG. 13 is a top view illustrating a method for manufacturing the light-emitting device.

FIG. 13 corresponds to a top view of a pixel in which the transistor 406, the transistor 407, the transistor 408, and the storage capacitor 409 are formed. FIG. 9C shows a cross-sectional view taken along broken line A-A' in FIG. 13, a cross-sectional view taken along broken line B-B' in FIG. 13, and a cross-sectional view taken along broken line C-C' in FIG. 13. In FIG. 13, the electrode 416 and the gate electrode 415 of the transistor 407 are formed using a series of the conductive films 411 and 412. A region where the gate insulating film 410 is interposed between the semiconductor film 405 and the electrode 416 functions as the storage capacitor 409. In addition, in FIG. 13, the first scan line Gaj and the second scan line Gbj which are included in the pixel are formed using the conductive films 411 and 412, respectively. Further, in FIG. 13, a transistor 451 formed using a semiconductor film 450 is provided in the pixel. Over the semiconductor film 450, a gate electrode 452 is formed using the conductive films 411 and 412. In FIG. 13, the first scan line Gaj, the gate electrode 414 of the transistor 407, and the gate electrode 452 of the transistor 451 are formed using a series of the conductive films 411 and 412. In FIG. 13, a transistor 453 formed using the semiconductor film 403 is provided in the pixel. Over the semiconductor film 403, a pair of gate electrodes 454 is formed using the conductive films 411 and 412. In FIG. 13, the second scan line Gbj and the gate electrodes 454 of the transistor 453 are formed using a series of the conductive films 411 and 412. Further, in FIG. 13, part 455 of the first power supply line Vai is formed using the conductive films 411 and 412.

Note that for the gate insulating film 410, a single layer or stacked layers of silicon oxide, silicon nitride, silicon nitride oxide, silicon oxynitride, or the like are used, for example. In the case of using the stacked layers, for example, a three-layer structure of a silicon oxide film, a silicon nitride film, and a silicon oxide film which are stacked from the substrate 400 side is preferably used. Further, as the formation method, plasma enhanced CVD, sputtering, or the like can be used. For example, in the case where the gate insulating film is formed using silicon oxide by plasma enhanced CVD, a mixed gas of TEOS (tetraethyl orthosilicate) and $O_2$ is used; reaction pressure is set to 40 Pa; substrate temperature is set to higher than or equal to 300° C. and lower than or equal to 400° C.; and high-frequency (13.56 MHz) power density is set to greater than or equal to 0.5 $W/cm^2$ and less than or equal to 0.8 $W/cm^2$.

The gate insulating film 410 may be formed by oxidizing or nitriding surfaces of the semiconductor film 403, the semiconductor film 404, the semiconductor film 405, and the semiconductor film 450 by high-density plasma treatment. The high-density plasma treatment is performed by using, for example, a mixed gas of a rare gas such as He, Ar, Kr, or Xe, and oxygen, nitrogen oxide, ammonia, nitrogen, or hydrogen. In this case, by exciting plasma by introduction of microwaves, plasma with a low electron temperature and high density can be generated. The surfaces of the semiconductor film 403, the semiconductor film 404, the semiconductor film 405, and the semiconductor film 450 are oxidized or nitrided by oxygen radicals (OH radicals are included in some cases) or nitrogen radicals (NH radicals are included in some cases) generated by such high-density plasma, so that an insulating film having a thickness greater than or equal to 1 nm and less than or equal to 20 nm, typically greater than or equal to 5 nm and less than or equal to 10 nm is formed so as to be in contact with the semiconductor film 403, the semiconductor film 404, the semiconductor film 405, and the semiconductor film 450. The insulating film having a thickness greater than or equal to 5 nm and less than or equal to 10 nm is used as the gate insulating film 410

Oxidation or nitridation of the semiconductor films by the above high-density plasma treatment proceeds by solid-phase reaction. Therefore, interface state density between the gate insulating film and the semiconductor films can be suppressed extremely low. Further, by directly oxidizing or nitriding the semiconductor films by high-density plasma treatment, variation in thickness of the insulating film to be formed can be suppressed. Furthermore, in the case where the semiconductor films have crystallinity, the surfaces of the semiconductor films are oxidized by solid-phase reaction by using high-density plasma treatment, so that crystal grain boundaries can be prevented from being locally oxidized at fast speed and a uniform gate insulating film having low interface state density can be formed. As for a transistor in which an insulating film formed by high-density plasma treatment is included in part of or the whole gate insulating film, variation in characteristics can be suppressed.

Alternatively, aluminum nitride can be used for the gate insulating film 410. Aluminum nitride has relatively high thermal conductivity and can effectively diffuse heat generated in a transistor. Alternatively, after silicon oxide, silicon oxynitride, or the like which does not contain aluminum is formed, aluminum nitride may be stacked thereon to form the gate insulating film.

In addition, although the gate electrode 413, the gate electrode 414, the gate electrode 415, the gate electrode 452, the gate electrodes 454, the electrode 416, the first scan line Gaj, the second scan line Gbj, and the part 455 of the first power supply line Vai are formed using the stacked two conductive films 411 and 412 in this embodiment mode, one mode illustrated in this specification is not limited to this structure. Instead of the conductive films 411 and 412, a single-layer conductive film or a staked-layer conductive film in which three or more layers are stacked may be used. In the case of using a three-layer structure in which three or more conductive films are stacked, a layered structure of a molybdenum film, an aluminum film, and a molybdenum film may be used.

For the conductive film for forming the gate electrode 413, the gate electrode 414, the gate electrode 415, the gate electrode 452, the gate electrodes 454, the electrode 416, the first scan line Gaj, the second scan line Gbj, and the part 455 of the first power supply line Vai, tantalum (Ta), tungsten (W), titanium (Ti), molybdenum (Mo), aluminum (Al), copper (Cu), chromium (Cr), niobium (Nb), or the like can be used. Alternatively, an alloy containing any of the above metals as its main component or a compound containing any of the above metals can be used. Alternatively, the conductive film may be formed using a semiconductor such as polycrystalline silicon, in which a semiconductor film is doped with an impurity element which imparts conductivity, such as phosphorus.

In this embodiment mode, tantalum nitride or tantalum (Ta) is used for the conductive film 411, which is a first layer, and tungsten (W) is used for the conductive film 412, which is a second layer. As well as the example described in this embodiment mode, the following combination of two conductive films can be used: tungsten nitride and tungsten; molybdenum nitride and molybdenum; aluminum and tantalum; aluminum and titanium; and the like. Since tungsten and tantalum nitride have high heat resistance, heat treatment for thermal activation can be performed in a step after forming the two-layer conductive films. Alternatively, as the combination of the two-layer conductive films, silicon doped with an impurity which imparts n-type conductivity and nickel silicide, Si doped with an impurity which imparts n-type conductivity and $WSi_x$, or the like can be used.

CVD, sputtering, or the like can be used for forming the conductive films 411 and 412. In this embodiment mode, the conductive film 411, which is the first layer, is formed to a thickness greater than or equal to 20 nm and less than or equal to 100 nm and the conductive film 412, which is the second layer, is formed to a thickness greater than or equal to 100 nm and less than or equal to 400 nm.

Note that as a mask used in forming the gate electrode 413, the gate electrode 414, the gate electrode 415, the gate electrode 452, the gate electrodes 454, the electrode 416, the first scan line Gaj, the second scan line Gbj, and the part 455 of the first power supply line Vai, a mask using silicon oxide, silicon oxynitride, or the like may be used instead of a resist. In this case, a step of forming the mask using silicon oxide, silicon oxynitride, or the like by patterning is additionally needed; however, the thickness of the mask is less reduced in etching as compared to the resist, so that the gate electrode 413, the gate electrode 414, the gate electrode 415, the gate electrode 452, the gate electrodes 454, the electrode 416, the first scan line Gaj, the second scan line Gbj, and the part 455 of the first power supply line Vai with desired shapes can be formed. Alternatively, without using the mask, the gate electrode 413, the gate electrode 414, the gate electrode 415, the gate electrode 452, the gate electrodes 454, the electrode 416, the first scan line Gaj, the second scan line Gbj, and the part 455 of the first power supply line Vai may be selectively formed by a droplet discharge method. Note that a droplet discharge method refers to a method for forming a predetermined pattern by discharging or ejecting a droplet containing a predetermined composition from an orifice and includes an inkjet method or the like in its category.

Note that when the gate electrode 413, the gate electrode 414, the gate electrode 415, the gate electrode 452, the gate electrodes 454, the electrode 416, the first scan line Gaj, the second scan line Gbj, and the part 455 of the first power supply line Vai are formed, an optimal etching method and an optimal etchant may be selected as appropriate in accordance with materials used for the conductive films. An example of an etching method when tantalum nitride is used for the conductive film 411, which is the first layer, and tungsten is used for the conductive film 412, which is the second layer, is described in detail below.

First, after a tantalum nitride film is formed, a tungsten film is formed over the tantalum nitride film. Then, a mask is formed over the tungsten film and first etching is performed. In the first etching, etching is performed under a first etching condition, and then, under a second etching condition. In the first etching condition, etching is performed as follows: an ICP (inductively coupled plasma) etching method is used; $CF_4$, $Cl_2$, and $O_2$ are used for an etching gas with a flow rate of 25:25:10 (sccm); and an RF (13.56 MHz) power of 500 W is applied to a coil-shaped electrode at a pressure of 1 Pa to generate plasma. Then, an RF (13.56 MHz) power of 150 W is also applied to the substrate side (a sample stage) to apply negative self-bias voltage substantially. By using this first etching condition, it is possible to etching the tungsten film so that end portions thereof can have tapered shapes.

Next, etching is performed under the second etching condition. In the second etching conduction, etching is performed for about 30 seconds as follows: $CF_4$ and $Cl_2$ are used for an etching gas with a flow rate of 30:30 (sccm); and an RF (13.56 MHz) power of 500 W is applied to a coil-shaped electrode at a pressure of 1 Pa to generate plasma. Then, an RF (13.56 MHz) power of 20 W is also applied to the substrate side (a sample stage) to apply negative self-bias voltage substantially. In the second etching condition where $CF_4$ and $Cl_2$ are mixed with each other, the tungsten film and the tantalum nitride film are etched to the same or substantially the same degree.

In the first etching, by using an optimal shape for the mask, the end portions of the tantalum nitride film and the tungsten film have tapered shapes each having an angle greater than or equal to 15° and less than or equal to 45° due to the effect of the bias voltage applied to the substrate side. Note that in the gate insulating film 410, a portion which is exposed by the first etching is etched to be thinner than other portions which are covered with the tantalum nitride film and the tungsten film by about 20 to 50 nm.

Next, second etching is performed without removing the mask. In the second etching, the tungsten film is selectively etched using $CF_4$, $Cl_2$, and $O_2$ for an etching gas. In this case, the tungsten film is preferentially etched by the second etching; however, the tantalum nitride film is hardly etched.

Through the first etching and the second etching, it is possible to form the conductive film 411 using tantalum nitride and the conductive film 412 using tungsten, which has smaller width than the conductive film 411.

In addition, by using the conductive film 411 and the conductive film 412 formed through the first etching and the second etching as masks, impurity regions which function as the source regions, the drain regions, and the LDD regions can be separately formed in the semiconductor film 403, the semiconductor film 404, the semiconductor film 405, and the semiconductor film 450, without forming a mask additionally.

After the impurity regions are formed, the impurity regions may be activated by heat treatment. For example, after a silicon oxynitride film having a thickness of 50 nm is formed, heat treatment may be performed at 550° C. for 4 hours in a nitrogen atmosphere.

Alternatively, after a silicon nitride film containing hydrogen is formed to a thickness of 100 nm, heat treatment may be performed at 410° C. for 1 hour in a nitrogen atmosphere so that the semiconductor film 403, the semiconductor film 404, the semiconductor film 405, and the semiconductor film 450 are hydrogenated. Alternatively, the semiconductor film 403, the semiconductor film 404, the semiconductor film 405, and the semiconductor film 450 may be hydrogenated as follows: heat treatment is performed at higher than or equal to 400° C. and lower than or equal to 700° C. (preferably higher than or equal to 500° C. and lower than or equal to 600° C.) in a nitrogen atmosphere at an oxygen concentration less than or equal to 1 ppm, preferably less than or equal to 0.1 ppm; and then, heat treatment is performed at higher than or equal to 300° C. and lower than or equal to 450° C. for 1 to 12 hours in an atmosphere containing hydrogen at 3 to 100%. Through this step, dangling bonds can be terminated by thermally excited hydrogen. As a different hydrogenation method, plasma hydrogenation (using hydrogen excited by plasma) may be performed. Alternatively, activation treatment may be performed after an insulating film 417 which is to be formed later is formed.

For the heat treatment, a thermal annealing method using an annealing furnace, a laser annealing method, a rapid thermal annealing method (an RTA method), or the like can be used. By the heat treatment, not only hydrogenation but also activation of impurity elements which are added to the semiconductor film 403, the semiconductor film 404, the semiconductor film 405, and the semiconductor film 450 can be performed.

Through the above series of steps, the n-channel transistors 406 and 407, the p-channel transistor 408, the storage capacitor 409, the transistor 451, and the transistor 453 can be formed. Note that the method for manufacturing the transistors is not limited to the above process.

Figure 10A:
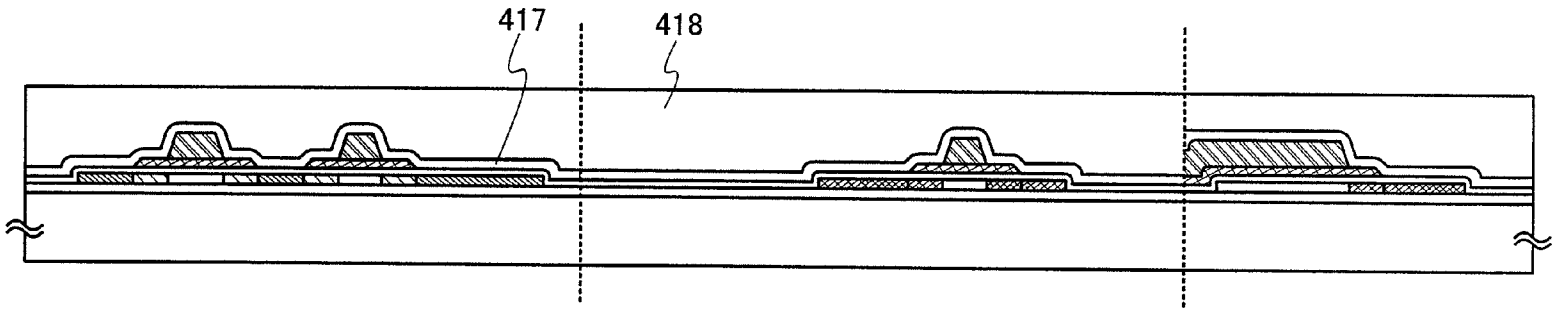
FIGS. 10A and 10B are cross-sectional views illustrating a method for manufacturing the light-emitting device.

Next, the insulating film 417 is formed so as to cover the transistor 406, the transistor 407, the transistor 408, and the storage capacitor 409 as shown in FIG. 10A and so as to cover the transistor 451 and the transistor 453 though not shown in FIG. 10A. Although the insulating film 417 is not necessarily provided, by providing the insulating film 417, impurities such as an alkali metal or an alkaline earth metal can be prevented from entering the transistor 406, the transistor 407, the transistor 408, and the storage capacitor 409; and the transistor 451 and the transistor 453 though not shown in FIG. 10A. Specifically, it is preferable to use silicon nitride, silicon nitride oxide, aluminum nitride, aluminum oxide, silicon oxide, silicon oxynitride, or the like for the insulating film 417. In this embodiment mode, a silicon oxynitride film having a thickness of about 600 nm is used for the insulating film 417. In this case, the above hydrogenation step may be performed after the silicon oxynitride film is formed.

Next, an insulating film 418 is formed over the insulating film 417 so as to cover the transistor 406, the transistor 407, the transistor 408, and the storage capacitor 409 as shown in FIG. 10A and so as to cover the transistor 451 and the transistor 453 though not shown in FIG. 10A. An organic material having heat resistance, such as acrylic, polyimide, benzocyclobutene, polyamide, or epoxy, can be used for the insulating film 418. As well as the above organic material, a low dielectric constant material (a low-k material), a siloxane-based resin, silicon oxide, silicon nitride, silicon oxynitride, silicon nitride oxide, PSG (phosphosilicate glass), BPSG (borophosphosilicate glass), alumina, or the like can be used. A Siloxane-based refers to a material in which a skeletal structure is formed by the bond of silicon (Si) and oxygen (O). A siloxane-based resin may have at least one kind of fluorine, a fluoro group, and an organic group (e.g., an alkyl group or an aromatic hydrocarbon group) as well as hydrogen, as a substituent. Note that the insulating film 418 may be formed by stacking a plurality of insulating films formed using such materials.

The insulating film 418 can be formed by CVD, sputtering, SOG, spin coating, dipping, spray coating, a droplet discharge method (e.g., an inkjet method, screen printing, or offset printing), a doctor knife, a roll coater, a curtain coater, a knife coater, or the like, depending on the material of the insulating film 418.

In this embodiment mode, the insulating film 417 and the insulating film 418 function as an interlayer insulating film; however, a single-layer insulating film may be used as the interlayer insulating film, or a stacked-layer insulating film having three or more layers may be used as the interlayer insulating film.

Next, contact holes are formed in the insulating film 417 and the insulating film 418 so that the semiconductor film 403, the semiconductor film 404, the semiconductor film 405, the gate electrode 413, and the semiconductor film 450 are partly exposed. As an etching gas for opening the contact holes, a mixed gas of $CHF_3$ and He is used; however, the etching gas is not limited to this. Further, conductive films 419 and 420 which are in contact with the semiconductor film 403 through the contact holes, a conductive film 421 which is in contact with the gate electrode 413 through the contact hole, a conductive film 422 which is in contact with the semiconductor film 404 through the contact hole, and conductive films 423 which are in contact with the semiconductor film 404 and the semiconductor film 405 through the contact holes are formed.

Figure 10B:
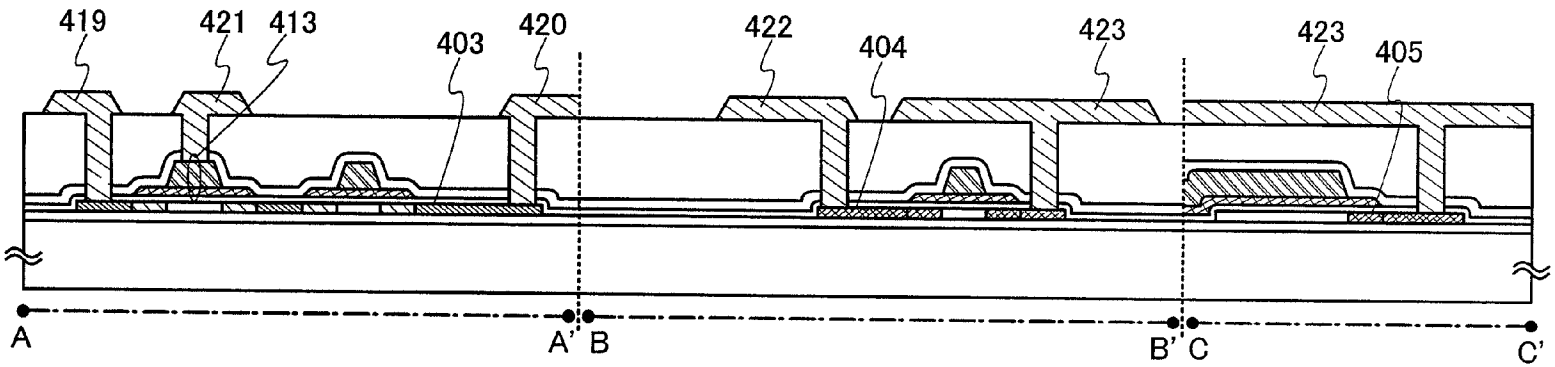
Figure 14:
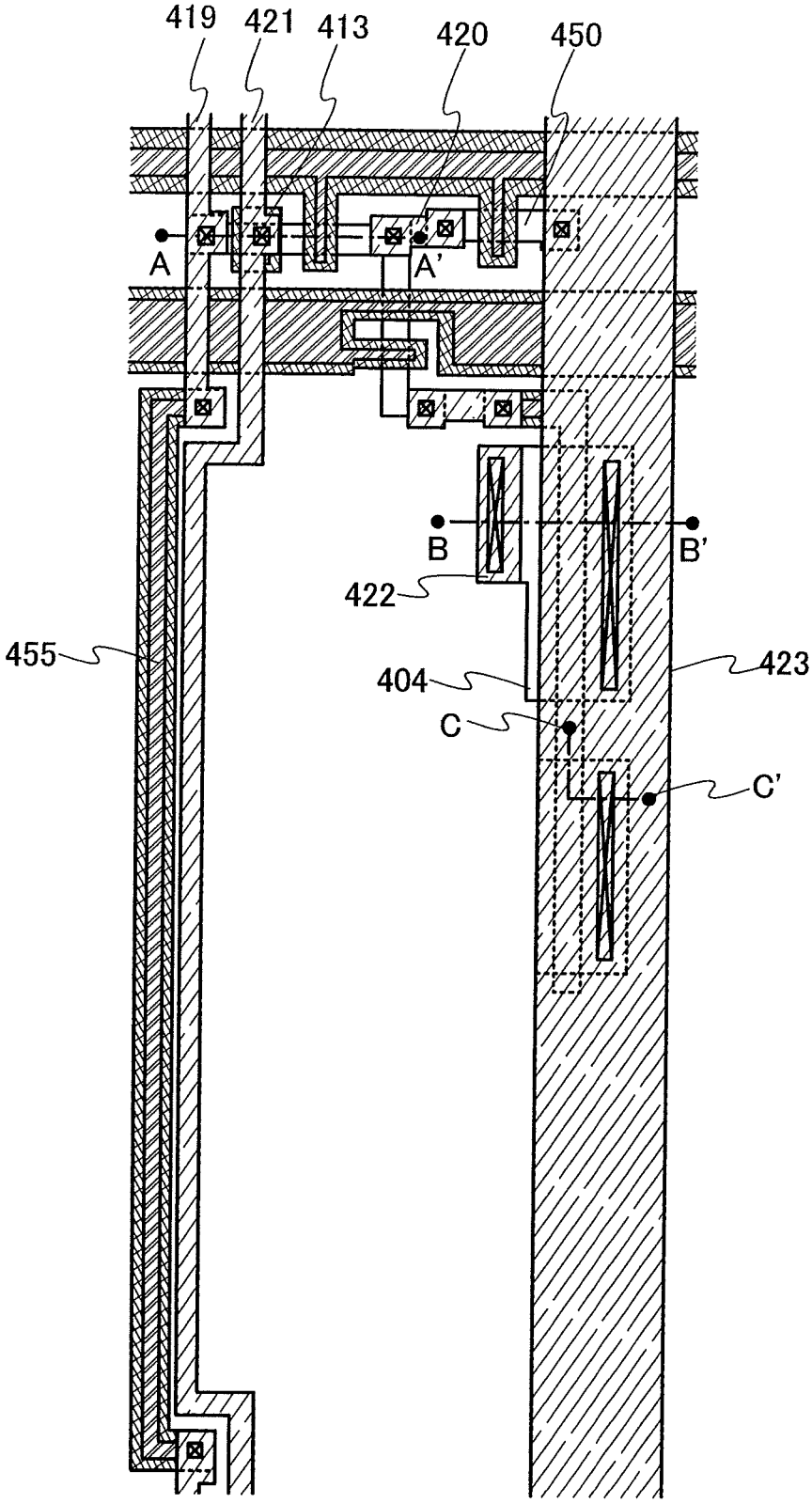
FIG. 14 is a top view illustrating a method for manufacturing the light-emitting device.

FIG. 14 corresponds to a top view of a pixel in which the conductive films 419 to 423 are formed. FIG. 10B shows a cross-sectional view taken along broken line A-A' in FIG. 14, a cross-sectional view taken along broken line B-B' in FIG. 14, and a cross-sectional view taken along broken line C-C' in FIG. 14. As shown in FIG. 14, the conductive film 419 is connected to the part 455 of the first power supply line Vai; and the conductive film 419 and the part 455 of the first power supply line Vai function as the first power supply line Vai. In addition, the conductive film 421 functions as a signal line. The conductive film 420 is in contact with the semiconductor film 450 in addition to the semiconductor film 403. Further, the conductive film 423 functions as the second power supply line Vbi.

The conductive films 419 to 423 can be formed by CVD, sputtering, or the like. Specifically, for the conductive films 419 to 423, aluminum (Al), tungsten (W), titanium (Ti), tantalum (Ta), molybdenum (Mo), nickel (Ni), platinum (Pt), copper (Cu), gold (Au), silver (Ag), manganese (Mn), neodymium (Nd), carbon (C), silicon (Si), or the like can be used. Alternatively, an alloy containing any of the above elements as its main component or a compound containing any of the above elements can be used. As the conductive films 419 to 423, a single-layer film having any of the above elements or a plurality of stacked films having any of the above elements can be used.

An example of an alloy containing aluminum as its main component is an alloy which contains aluminum as its main component and contains nickel. Further, an alloy which contains aluminum as its main component and contains nickel and one or both of carbon and silicon is an example of an alloy containing aluminum as its main component. Since aluminum and aluminum silicon have low resistance values and are inexpensive, aluminum and aluminum silicon are suitable for materials used for the conductive films 419 to 423. In particular, generation of hillocks in resist baking can be prevented more in the case where aluminum silicon is used for patterning the conductive films 419 to 423 than in the case where an aluminum film is used. Further, instead of silicon (Si), Cu may be mixed into the aluminum film at about 0.5%.

For example, a layered structure of a barrier film, an aluminum silicon film, and a barrier film or a layered structure of a barrier film, an aluminum silicon film, a titanium nitride film, and a barrier film may be used for the conductive films 419 to 423. Note that a barrier film refers to a film formed using titanium, nitride of titanium, molybdenum, or nitride of molybdenum. By forming barrier films so as to interpose an aluminum silicon film, generation of hillocks in aluminum or aluminum silicon can be further prevented. Alternatively, by forming the barrier film by using titanium that is a highly reducible element, even if a thin oxide film is formed over the semiconductor film 403, the semiconductor film 404, the semiconductor film 405, and the semiconductor film 450, the oxide film is reduced by titanium contained in the barrier film, so that favorable contact between the conductive films 419, 420, 422, and 423 and the semiconductor films 403, 404, 405, and 450 can be obtained. Further, a plurality of barrier films may be stacked. In that case, for example, a five-layer structure in which titanium, titanium nitride, aluminum silicon, titanium, and titanium nitride are stacked from the lowest layer can be used for the conductive films 419 to 423.

In this embodiment mode, a titanium film, an aluminum film, and a titanium film are stacked in that order from the insulating film 418 side. Then, these stacked films are patterned to form the conductive films 419 to 423.

Figure 11A:
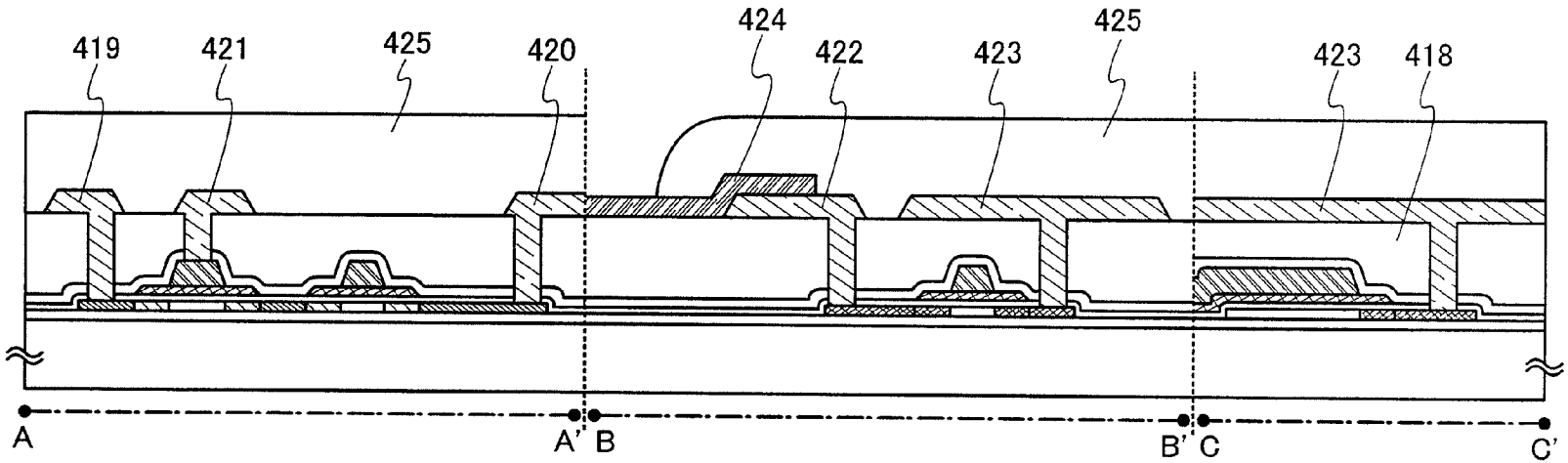
FIGS. 11A and 11B are cross-sectional views illustrating a method for manufacturing the light-emitting device.

Next, as shown in FIG. 11A, a pixel electrode 424 is formed so as to be in contact with the conductive film 422.

In this embodiment mode, after a light-transmitting conductive film is formed using indium tin oxide containing silicon oxide (ITSO) by sputtering, the conductive film is patterned to form the pixel electrode 424. Note that a light-transmitting oxide conductive material other than ITSO, such as indium tin oxide (ITO), zinc oxide (ZnO), indium oxide zinc (IZO), or zinc oxide to which gallium is added (GZO), may be used for the pixel electrode 424. Alternatively, for the pixel electrode 424, as well as the light-transmitting oxide conductive material, a single-layer film containing one or more of titanium nitride, zirconium nitride, Ti, W, Ni, Pt, Cr, Ag, Al, and the like, a layered structure of a titanium nitride and a film containing aluminum as its main component, a three-layer structure of a titanium nitride film, a film containing aluminum as its main component, and a titanium nitride film, or the like can be used, for example. Note that in the case where light is extracted from the pixel electrode 424 side by using a material other than the light-transmitting oxide conductive material, the pixel electrode 424 is formed to a thickness such that light can transmit therethrough (preferably about 5 to 30 nm).

In the case of using ITSO for the pixel electrode 424, a target in which silicon oxide is contained in ITO at 2 to 10 weight percent can be used. Specifically, in this embodiment mode, by using a target containing $In_2O_3$, $SnO_2$, and $SiO_2$ at a weight percent ratio of 85:10:5, a conductive film which serves as the pixel electrode 424 is formed to a thickness of 105 nm, with a flow rate of Ar at 50 sccm, a flow rate of $O_2$ at 3 sccm, a sputtering pressure of 0.4 Pa, a sputtering power of 1 kW, and a deposition rate of 30 nm/min.

Note that in the case where a metal having relatively high ionization tendency, such as aluminum, is used for a portion in the conductive film 422, which is in contact with the pixel electrode 424, electrolytic corrosion easily occurs in the conductive film 422 when a light-transmitting conductive oxide material is used for the pixel electrode 424. However, in this embodiment mode, the conductive film 422 is formed using the conductive film in which the titanium film, the aluminum film, and the titanium film are stacked in that order from the insulating film 418 side; and the pixel electrode 424 is in contact with at least the titanium film in the conductive film 422, which is formed in the top part. Thus, a metal film formed using a metal having relatively high ionization tendency, such as aluminum, is interposed between metal films formed using a metal having relatively low ionization tendency, such as titanium, so that poor connection due to electrolytic corrosion between the conductive film 422 and the pixel electrode 424 or other conductors can be prevented from occurring. Further, by using a metal film formed using a metal having relatively high conductivity, such as aluminum, for the conductive film 422, the resistance value of the whole conductive film 422 can be lowered.

Note that the conductive film which serves as the pixel electrode 424 can be formed using a conductive composition containing a conductive high-molecular compound (also referred to as a conductive polymer). It is preferable that the conductive film which is formed using the conductive composition and serves as the pixel electrode 424 have a sheet resistance of 10000 ohm/square or less and a light transmittance of 70% or more at a wavelength of 550 nm. The sheet resistance of the conductive film is preferably lower. In addition, it is preferable that the resistivity of the conductive high-molecular compound contained in the conductive composition be 0.1 ohm·cm or less.

Note that as the conductive high-molecular compound, a so-called $\pi$ electron conjugated conductive high-molecular compound can be used. For example, polyaniline and/or its derivatives, polypyrrole and/or its derivatives, polythiophene and/or its derivatives, copolymers of two or more kinds of them, and the like can be used as a $\pi$ electron conjugated conductive high-molecular compound.

As specific examples of a $\pi$ electron conjugated conductive high-molecular compound, the following can be given: polypyrrole, poly(3-methylpyrrole), poly(3-butylpyrrole), poly(3-octylpyrrole), poly(3-decylpyrrole), poly(3,4-dimethylpyrrole), poly(3,4-dibutylpyrrole), poly(3-hydroxypyrrole), poly(3-methyl-4-hydroxypyrrole), poly(3-methoxypyrrole), poly(3-ethoxypyrrole), poly(3-octoxypyrrole), poly(3-carboxypyrrole), poly(3-methyl-4-carboxypyrrole), poly(N-methylpyrrole), polythiophene, poly(3-methylthiophene), poly(3-butylthiophene), poly(3-octylthiophene), poly(3-decylthiophene), poly(3-dodecylthiophene), poly(3-methoxythiophene), poly(3-ethoxythiophene), poly(3-octoxythiophene), poly(3-carboxythiophene), poly(3-methyl-4-carboxythiophene), poly(3,4-ethylenedioxythiophene), polyaniline, poly(2-methylaniline), poly(2-octylaniline), poly(2-isobutylaniline), poly(3-isobutylaniline), poly(2-aniline sulfonic acid), poly(3-aniline sulfonic acid), and the like.

Any of the above π electron conjugated conductive high-molecular compounds may be used alone for the pixel electrode 424 as a conductive composition. Alternatively, any of the above π electron conjugated conductive high-molecular compounds can be used by adding an organic resin thereto in order to adjust film characteristics such as uniformity in thickness of a film of a conductive composition film and intensity of the film of the conductive composition.

The organic resin may be a thermosetting resin, a thermoplastic resin, or a photocurable resin as long as the organic resin is compatible with the conductive high-molecular compound or can be mixed and dispersed into the conductive high-molecular compound. For example, the following can be used: a polyester-based resin such as polyethylene terephthalate, polybutylene terephthalate, or polyethylene naphthalate; a polyimide-based resin such as polyimide or polyamide imide; a polyamide resin such as polyamide 6, polyamide 66, polyamide 12, or polyamide 11; a fluorine resin such as poly(vinylidene fluoride), poly(vinyl fluoride), polytetrafluoroethylene, ethylene tetrafluoroethylene copolymer, or polychlorotrifluoroethylene; a vinyl resin such as polyvinyl alcohol, polyvinyl ether, polyvinyl butyral, polyvinyl acetate, or polyvinyl chloride; an epoxy resin; a xylene resin; an aramid resin; a polyurethane-based resin; a polyurea-based resin; a melamine resin; a phenol-based resin; polyether; an acrylic-based resin; or a copolymer of any of these resins.

Further, in order to adjust the electric conductivity of the conductive composition, the conductive composition may be doped with an acceptor dopant or a donor dopant so that an oxidation-reduction potential of a conjugated electron in the π electron conjugated conductive high-molecular compound can be changed.

As an acceptor dopant, a halogen compound, a Lewis acid, a protonic acid, an organic cyano compound, an organic metal compound, or the like can be used. As a halogen compound, there are chlorine, bromine, iodine, iodine chloride, iodine bromide, iodine fluoride, and the like. As a Lewis acid, there are phosphorus pentafluoride, arsenic pentafluoride, antimony pentafluoride, boron trifluoride, boron trichloride, boron tribromide, and the like. As a protonic acid, there are inorganic acid such as hydrochloric acid, sulfuric acid, nitric acid, phosphoric acid, fluoroboric acid, hydrofluoric acid, or perchloric acid and organic acid such as organic carboxylic acid or organic sulfonic acid. As organic carboxylic acid and organic sulfonic acid, the above carboxylic acid compound and sulfonic acid compound can be used. As the organic cyano compound, a compound in which two or more cyano groups are included in a conjugated bond can be used. As an organic cyano compound, a compound having two or more cyano groups in a conjugated bond can be used. For example, tetracyanoethylene, tetracyanoethylene oxide, tetracyanobenzene, tetracyanoquinodimethane, tetracyanoazanaphthalene, or the like can be used.

As a donor dopant, alkali metal, alkaline earth metal, a quaternary amine compound, or the like can be used.

The conductive composition is dissolved in water or an organic solvent (e.g., an alcohol-based solvent, a ketone-based solvent, an ester-based solvent, a hydrocarbon-based solvent, or an aromatic-based solvent), so that the conductive film which serves as the pixel electrode 424 can be formed by a wet process.

A solvent in which the conductive composition is dissolved is not particularly limited to a certain solvent. A solvent in which the above conductive high-molecular compound and a high-molecular resin compound such as an organic resin are dissolved may be used. For example, the conductive composition may be dissolved in any one or a mixture of water, methanol, ethanol, propylene carbonate, N-methylpyrrolidone, dimethylformamide, dimethylacetamide, cyclohexanone, acetone, methyl ethyl ketone, methyl isobutyl ketone, toluene, or the like.

After the conductive composition is dissolved in a solvent as described above, deposition thereof can be performed by a wet process such as an application method, a coating method, a droplet discharge method (also referred to as an inkjet method), or a printing method. The solvent may be evaporated by thermal treatment or may be evaporated under reduced pressure. In the case where the organic resin is a thermosetting resin, heat treatment may be further performed. In the case where the organic resin is a photocurable resin, light irradiation treatment may be performed.

After the conductive film which serves as the pixel electrode 424 is formed, the surface thereof may be cleaned or polished by, for example, CMP or by cleaning with a polyvinyl alcohol-based porous body so that the surface thereof is flattened.

Next, as shown in FIG. 11A, a partition 425 having an opening portion is formed over the insulating film 418 so as to cover part of the pixel electrode 424, and the conductive films 419 to 423. Part of the pixel electrode 424 is exposed in the opening portion of the partition 425. The partition 425 can be formed using an organic resin film, an inorganic insulating film, or a siloxane-based insulating film. In the case of using an organic resin film, for example, acrylic, polyimide, or polyamide can be used. In the case of using an inorganic insulating film, silicon oxide, silicon nitride oxide, or the like can be used. In particular, by using a photosensitive organic resin film for the partition 425 and forming an opening portion over the pixel electrode 424 so that the side wall of the opening portion has an inclined surface of continuous curvature, the pixel electrode 424 and a common electrode 427 which is to be formed later can be prevented from being connected to each other. In this case, a mask can be formed by a droplet discharge method or a printing method. Further, the partition 425 itself can be formed by a droplet discharge method or a printing method.

Figure 15:
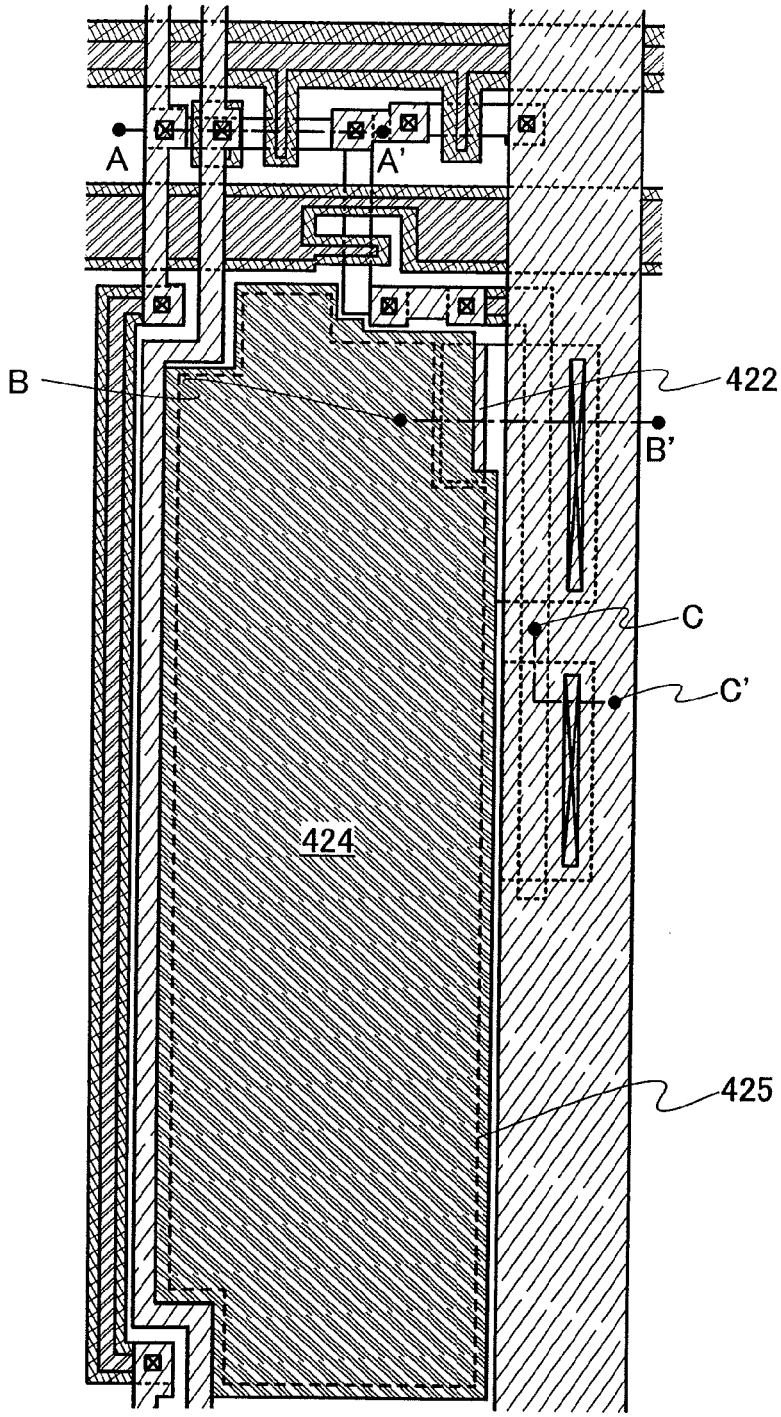
FIG. 15 is a top view illustrating a method for manufacturing the light-emitting device.

FIG. 15 corresponds to a top view of a pixel in which the pixel electrode 424 and the partition 425 are formed. FIG. 10B shows a cross-sectional view taken along broken line A-A' in FIG. 15, a cross-sectional view taken along broken line B-B' in FIG. 15, and a cross-sectional view taken along broken line C-C' in FIG. 15. Note that in FIG. 15, the position of the opening portion in the partition 425 is represented by a broken line.

Next, before an electroluminescent layer 426 is formed, heat treatment under an air atmosphere or heat treatment (vacuum baking) under a vacuum atmosphere may be performed in order to remove moisture, oxygen, or the like adsorbed in the partition 425 and the pixel electrode 424. Specifically, heat treatment is performed at a substrate temperature of higher than or equal to 200° C. and lower than or equal to 450° C., preferably higher than or equal to 250° C. and lower than or equal to 300° C. for about 0.5 to 20 hours in a vacuum atmosphere. The heat treatment is preferably performed at a pressure lower than or equal to $3\times10^{-7}$ Torr in a vacuum atmosphere, most preferably at a pressure lower than or equal to $3\times10^{-8}$ Torr in a vacuum atmosphere if possible. In addition, in the case where the electroluminescent layer 426 is deposited after the heat treatment is performed in a vacuum atmosphere, the reliability can be further improved by putting the substrate in the vacuum atmosphere just before the deposition of the electroluminescent layer 426. Further, the pixel electrode 424 may be irradiated with an ultraviolet ray before or after the vacuum baking.

Figure 11B:
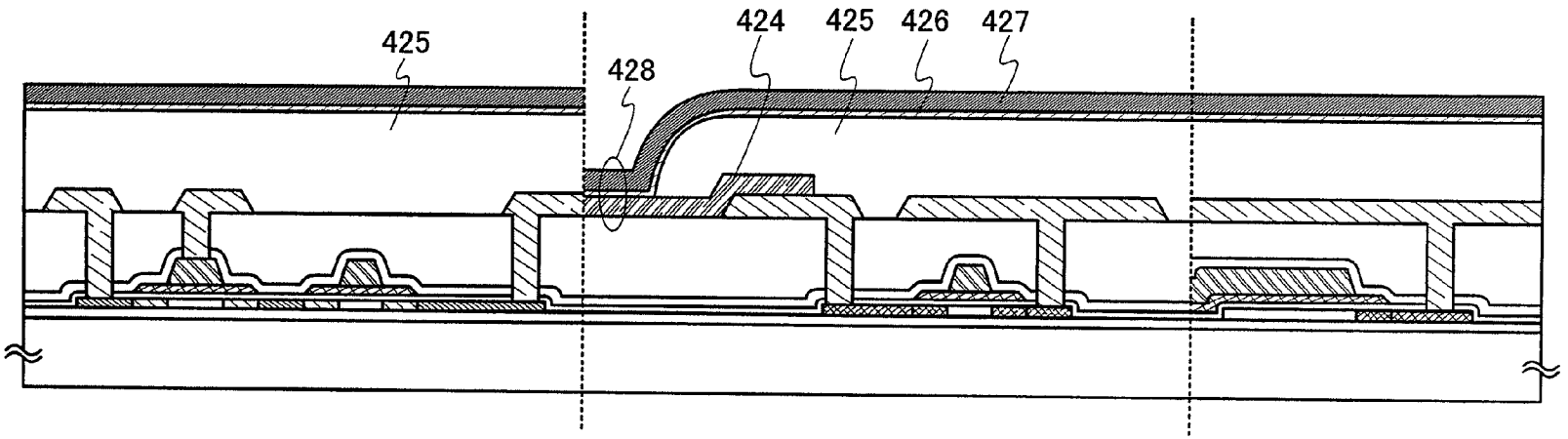

Next, as shown in FIG. 11B, the electroluminescent layer 426 is formed so as to be in contact with the pixel electrode 424 in the opening portion of the partition 425. The electroluminescent layer 426 may be formed using either a single layer or by stacking a plurality of layers; and an inorganic material as well as an organic material may be included in each layer. Luminescence of the electroluminescent layer 426 refers to light emission (fluorescence) in returning from a singlet-excited state to a ground state and light emission (phosphorescence) in returning from a triplet-excited state to a ground state. In the case where the electroluminescent layer 426 is formed using a plurality of layers, an electron injection layer, an electron transport layer, a light-emitting layer, a hole transport layer, and a hole injection layer are stacked in that order over the pixel electrode 424 which corresponds to a cathode. Note that in the case where the pixel electrode 424 corresponds to an anode, the electroluminescent layer 426 is formed by stacking a hole injection layer, a hole transport layer, a light-emitting layer, an electron transport layer, and an electron injection layer in that order.

Alternatively, the electroluminescent layer 426 can be formed by a droplet discharge method by using any of a high-molecular organic compound, an intermediate-molecular organic compound (an organic compound having no sublimation property and having a molecular chain length less than or equal to 10 μm), a low-molecular organic compound, and an inorganic compound. Further, an intermediate-molecular organic compound, a low-molecular organic compound, and an inorganic compound may be formed by vapor deposition.

Next, the common electrode 427 is formed so as to cover the electroluminescent layer 426. For the common electrode 427, a metal, an alloy, or an electroconductive compound, which generally has a small work function, a mixture thereof, or the like can be used. Specifically, the common electrode 427 can be formed using an alkali metal such as Li or Cs; an alkaline earth metal such as Mg, Ca, or Sr; an alloy containing any of these metals (e.g., Mg:Ag or Al:Li); or a rare earth metal such as Yb or Er. Further, by forming a layer containing a material having a high electron injection property so as to be in contact with the common electrode 427, a normal conductive film formed using aluminum, a light-transmitting oxide conductive material, or the like can be used.

The pixel electrode 424, the electroluminescent layer 426, and the common electrode 427 overlap with each other in the opening portion of the partition 425, so that a light-emitting element 428 is formed.

Note that light from the light-emitting element 428 may be extracted from the pixel electrode 424 side, the common electrode 427 side, or both sides. In accordance with an objective structure among the three structures described above, the material and the thickness of each of the pixel electrode 424 and the common electrode 427 are selected.

Note that an insulating film may be formed over the common electrode 427 after the light-emitting element 428 is formed. As the insulating film, a film through which a substance which causes increase in deterioration of a light-emitting element, such as moisture or oxygen, penetrates in smaller amount than those of other insulating films is used. Typically, for example, a DLC film, a carbon nitride film, a silicon nitride which is formed by RF sputtering, or the like is preferably used. Alternatively, the above film through which a substance such as moisture or oxygen penetrates in smaller amount and a film through which a substance such as moisture or oxygen penetrates in larger amount than that of the film are stacked so that the films can be used as the above insulating film.

Note that in practice, when the process is completed up to and including FIG. 11B, packaging (encapsulation) is preferably performed using a protective film (e.g., an attachment film or an ultraviolet curable resin film) or a cover material, which has high airtightness and causes less degassing, so that additional exposure to the air is prevented.

Through the above process, the light-emitting device that is one mode illustrated in this specification can be manufactured.

Note that although the method for manufacturing the semiconductor element in the pixel portion is described in this embodiment mode, a transistor used for a driver circuit or an integrated circuit can be formed together with the transistors in the pixel portion. In this case, it is not necessary that the thickness of the gate insulating film 410 be the same in all of the transistors in the pixel portion and the transistor used for the driver circuit or the integrated circuit. For example, in the transistor used for the driver circuit or the integrated circuit, which needs to be operated at high speed, the thickness of the gate insulating film 410 may be smaller than that of the transistors in the pixel portion.

Further, by using an SOI (silicon on insulator) substrate, a single crystal semiconductor can be used for the semiconductor element. An SOI substrate can be manufactured using, for example, an attachment method such as UNIBOND (registered trademark) typified by Smart Cut (registered trademark), epitaxial layer transfer (ELTRAN), a dielectric separation method, or plasma assisted chemical etching (PACE); separation by implanted oxygen (SIMOX); or the like.

By transferring the semiconductor element manufactured using the above method to a flexible substrate such as a plastic substrate, the light-emitting device may be formed. As a transferring method, any of the following methods can be used; a method by which a metal oxide film is formed between the substrate and the semiconductor element and the metal oxide film is weakened by crystallization so that the semiconductor element is separated from the substrate and transferred; a method by which an amorphous silicon film containing hydrogen is provided between the substrate and the semiconductor element and the amorphous silicon film is removed by laser light irradiation or etching so that the semiconductor element is separated from the substrate and transferred; a method by which the substrate over which the semiconductor element is formed is mechanically removed or is removed by etching with a solution or a gas so that the semiconductor element is separated from the substrate and transferred; and the like. Note that the semiconductor element is preferably transferred before the light-emitting element is manufactured.

This embodiment mode can be combined with the aforementioned embodiment mode as appropriate.

Embodiment 1

In this embodiment, a method for manufacturing a light-emitting device that is one mode illustrated in this specification, by which a semiconductor element is formed by using a semiconductor film which is transferred from a semiconductor substrate (a bond substrate) to a support substrate (a base substrate), is described.

Figure 16A:
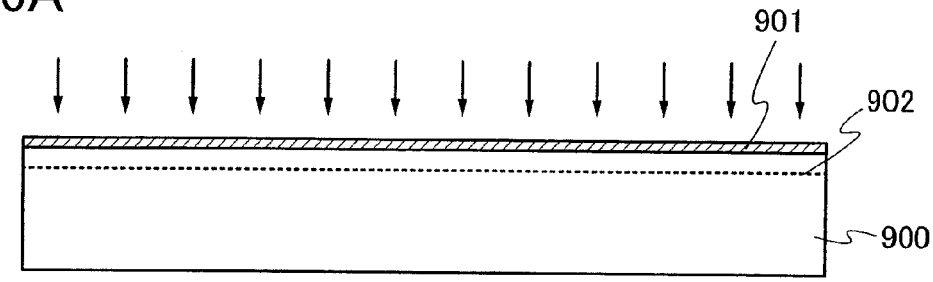
FIGS. 16A to 16D are cross-sectional views illustrating a method for manufacturing a light-emitting device.

First, as shown in FIG. 16A, an insulating film 901 is formed over a bond substrate 900. The insulating film 901 is formed using an insulating material such as silicon oxide, silicon oxynitride, silicon nitride oxide, or silicon nitride. The insulating film 901 can be formed using either a single insulating film or by stacking a plurality of insulating films. For example, in this embodiment, the insulating film 901 is formed by stacking silicon oxynitride containing more oxygen than nitrogen and silicon nitride oxide containing more nitrogen than oxygen in that order from the bond substrate 900 side.

For example, in the case of using silicon oxide for the insulating film 901, the insulating film 901 can be formed using a mixed gas of silane and oxygen, a mixed gas of tetraethoxysilane (TEOS) and oxygen, or the like by vapor deposition such as thermal CVD, plasma enhanced CVD, atmospheric pressure CVD, or bias ECRCVD. In this case, a surface of the insulating film 901 may be densified by oxygen plasma treatment. Alternatively, in the case of using silicon nitride for the insulating film 901, the insulating film 901 can be formed using a mixed gas of silane and ammonia by vapor deposition such as plasma enhanced CVD. Alternatively, in the case of using silicon nitride oxide for the insulating film 901, the insulating film 901 can be formed using a mixed gas of silane and ammonia or a mixed gas of silane and nitrogen oxide by vapor deposition such as plasma enhanced CVD.

Alternatively, silicon oxide formed using an organosilane gas by chemical vapor deposition may be used for the insulating film 901. As an organosilane gas, a silicon-containing compound such as tetraethoxysilane (TEOS) (chemical formula: $Si(OC_2H_5)_4$), tetramethylsilane (TMS) (chemical formula: $Si(CH_3)_4$), tetramethylcyclotetrasiloxane (TMCTS), octamethylcyclotetrasiloxane (OMCTS), hexamethyldisilazane (HMDS), triethoxysilane ($SiH(OC_2H_5)_3$), or trisdimethylaminosilane ($SiH(N(CH_3)_2)_3$) can be used.

Next, as shown in FIG. 16A, hydrogen or a rare gas, or hydrogen ions or rare gas ions are introduced into the bond substrate 900 as indicated by arrows, so that a defect layer 902 having microvoids is formed at a given depth from a surface of the bond substrate 900. The position where the defect layer 902 is formed is determined by accelerating voltage at the time of the introduction. Since the thickness of a semiconductor film 908 which is transferred from the bond substrate 900 to the base substrate 904 is determined by the position of the defect layer 902, the accelerating voltage at the time of the introduction is set taking the thickness of the semiconductor film 908 into consideration. The thickness of the semiconductor film 908 is greater than or equal to 10 nm and less than or equal to 200 nm, preferably greater than or equal to 10 nm and less than or equal to 50 nm. For example, when hydrogen is introduced into the bond substrate 900, the dosage is preferably greater than or equal to $3\times10^{16}/cm^2$ and less than or equal to $1\times10^{17}/cm^2$.

Note that since hydrogen or a rare gas, or hydrogen ions or rare gas ions are introduced into the bond substrate 900 at a high concentration in the step of forming the defect layer 902, the surface of the bond substrate 900 becomes rough and sufficient strength for attaching the base substrate 904 and the bond substrate 900 to each other cannot be obtained in some cases. By providing the insulating film 901, the surface of the bond substrate 900 is protected when hydrogen or a rare gas, or hydrogen ions or rare gas ions are introduced into the bond substrate 900, so that the base substrate 904 and the bond substrate 900 can be attached to each other favorably.

Figure 16B:
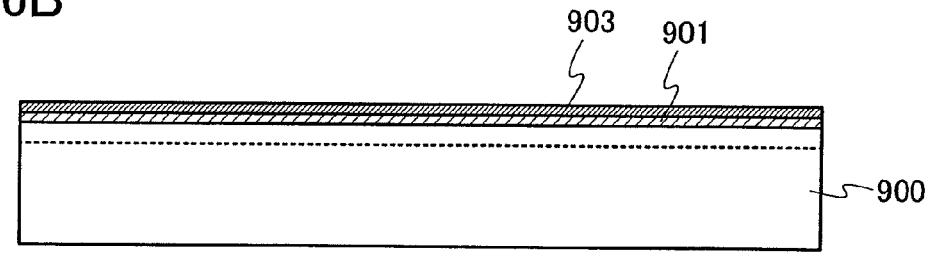

Next, as shown in FIG. 16B, an insulating film 903 is formed over the insulating film 901. In a manner similar to that of the insulating film 901, the insulating film 903 is formed using an insulating material such as silicon oxide, silicon oxynitride, silicon nitride oxide, or silicon nitride. The insulating film 903 can be formed using either a single insulating film or by stacking a plurality of insulating films. Further, silicon oxide formed using an organosilane gas by chemical vapor deposition may be used for the insulating film 903. In this embodiment, silicon oxide formed using an organosilane gas by chemical vapor deposition is used for the insulating film 903.

Note that by using an insulating film having a high barrier property, such as a silicon nitride film or a silicon nitride oxide film, as the insulating film 901 or the insulating film 903, impurities such as an alkali metal or an alkaline earth metal can be prevented from entering a semiconductor film 909 which is to be formed later, from the base substrate 904.

Note that although the insulating film 903 is formed after the defect layer 902 is formed in this embodiment, the insulating film 903 is not necessarily provided. Note that since the insulating film 903 is formed after the defect layer 902 is formed, the insulating film 903 has a flatter surface than the insulating film 901 formed before the defect layer 902 is formed. Thus, by providing the insulating film 903, the strength of attachment which is to be performed later can be further increased.

Next, before the bond substrate 900 and the base substrate 904 are attached to each other, hydrogenation may be performed on the bond substrate 900. Hydrogenation is performed, for example, at 350° C. for about 2 hours in a hydrogen atmosphere.

Figure 16C:
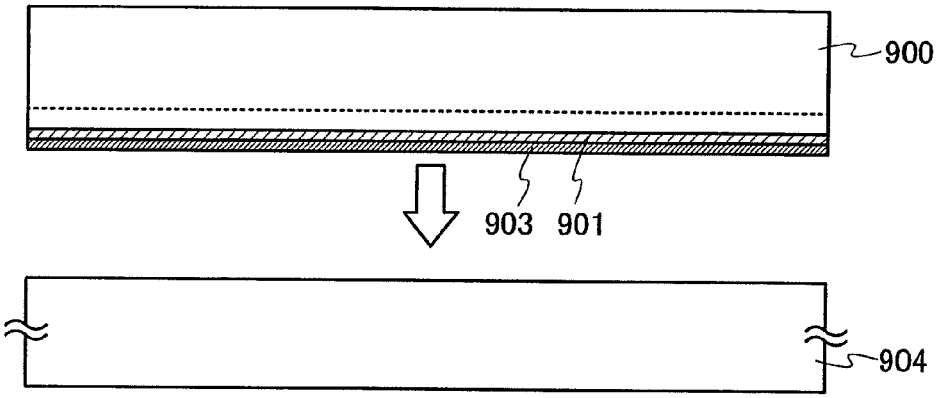
Figure 16D:
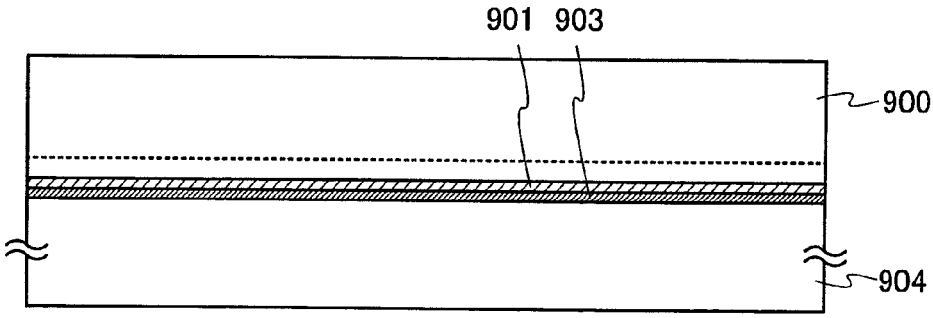

Next, as shown in FIG. 16C, the bond substrate 900 is stacked over the base substrate 904 so that the insulating film 903 is interposed therebetween. Then, the bond substrate 900 and the base substrate 904 are attached to each other, as shown in FIG. 16D. The insulating film 903 is attached to the base substrate 904, so that the bond substrate 900 and the base substrate 904 can be attached to each other.

Since the bond substrate 900 and the base substrate 904 are attached to each other by van der Waals force, the substrates are firmly attached to each other even at room temperature. Note that since the attachment can be performed at low temperature, various substrates can be used as the base substrate 904. For example, as well as a glass substrate such as an aluminosilicate glass substrate, a barium borosilicate glass substrate, or an aluminoborosilicate glass substrate, a substrate such as a quartz substrate or a sapphire substrate can be used as the base substrate 904. Alternatively, a semiconductor substrate formed using silicon, gallium arsenide, indium phosphide, or the like can be used as the base substrate 904.

Note that an insulating film may also be formed over a surface of the base substrate 904 and the insulating film may be attached to the insulating film 903. In this case, as well as the above substrates, a metal substrate such as a stainless steel substrate can be used as the base substrate 904. There is a tendency that a flexible substrate formed of a synthetic resin such as plastics generally has a lower allowable temperature limit than the above substrates; however, such a substrate can be used as the base substrate 904 as long as it can withstand processing temperature in manufacturing steps. As a plastic substrate, polyester typified by polyethylene terephthalate (PET), polyethersulfone (PES), polyethylene naphthalate (PEN), polycarbonate (PC), polyetheretherketone (PEEK), polysulfone (PSF), polyetherimide (PEI), polyarylate (PAR), polybutylene terephthalate (PBT), polyimide, an acrylonitrile butadiene styrene resin, polyvinyl chloride, polypropylene, polyvinyl acetate, an acrylic resin, or the like can be used.

A single crystal semiconductor substrate or a polycrystalline semiconductor substrate formed using silicon, germanium, or the like can be used as the bond substrate 900. Alternatively, a single crystal semiconductor substrate or a polycrystalline semiconductor substrate formed using a compound semiconductor such as gallium arsenide or indium phosphide can be used as the bond substrate 900. Alternatively, a semiconductor substrate formed using silicon having lattice distortion, silicon germanium in which germanium is added to silicon, or the like may be used as the bond substrate 900. Silicon having lattice distortion can be formed by being deposited over silicon germanium or silicon nitride, which has a larger lattice constant than silicon.

Note that heat treatment or pressure treatment may be performed after the base substrate 904 and the bond substrate 900 are attached to each other. By performing heat treatment or pressure treatment, the attachment strength can be increased.

Figure 17A:
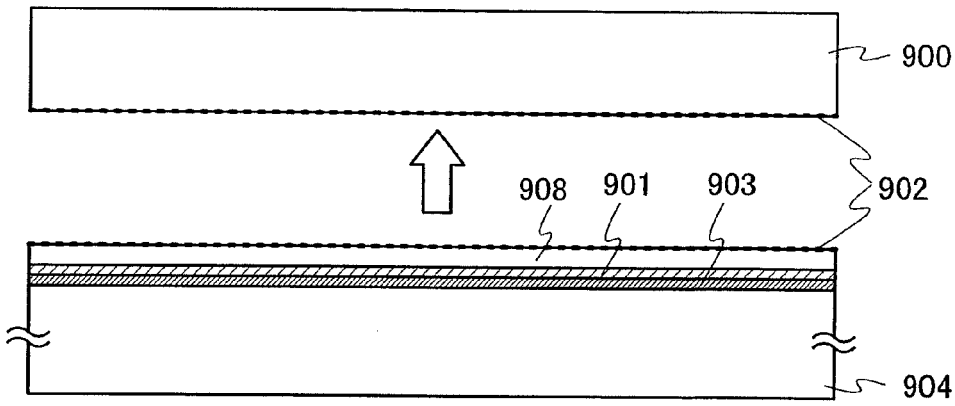
FIGS. 17A to 17C are cross-sectional views illustrating a method for manufacturing the light-emitting device.

By performing heat treatment after the attachment is performed, adjacent microvoids in the defect layer 902 are combined with each other and the volume of the microvoid is increased. Accordingly, as shown in FIG. 17A, the bond substrate 900 is cleaved along the defect layer 902, so that the semiconductor film 908 which is part of the bond substrate 900 is separated from the bond substrate 900. The heat treatment is preferably performed at a temperature which is lower than or equal to the allowable temperature limit of the base substrate 904. For example, the heat treatment is performed at a temperature higher than or equal to 400° C. and lower than or equal to 600° C. With this separation, the semiconductor film 908 is transferred together with the insulating film 901 and the insulating film 903 to the base substrate 904. After that, heat treatment at a temperature higher than or equal to 400° C. and lower than or equal to 600° C. is preferably performed in order to attach the insulating film 903 and the base substrate 904 to each other more firmly.

The crystalline orientation of the semiconductor film 908 can be controlled with the plane orientation of the bond substrate 900. The bond substrate 900 having crystalline orientation which is suitable for a semiconductor element which is to be formed may be selected as appropriate. Further, the mobility of a transistor differs depending on the crystalline orientation of the semiconductor film 908. When a transistor having higher mobility is desired to be obtained, the direction of the attachment of the bond substrate 900 is set taking the direction of a channel and the crystalline orientation into consideration.

Next, a surface of the semiconductor film 908 transferred is flattened. Although flattening is not necessarily performed, by performing flattening, characteristics of an interface between the semiconductor film 908 and a gate insulating film in a transistor which is to be formed later can be improved. Specifically, flattening can be performed by chemical mechanical polishing (CMP). The thickness of the semiconductor film 908 is decreased by the flattening.

Note that although the case where Smart Cut (registered trademark) is used by which the semiconductor film 908 is separated from the bond substrate 900 by forming the defect layer 902 is described in this embodiment, the semiconductor film 908 may be attached to the base substrate 904 by a different attachment method such as epitaxial layer transfer (ELTRAN), a dielectric separation method, or plasma assisted chemical etching (PACE).

Figure 17B:
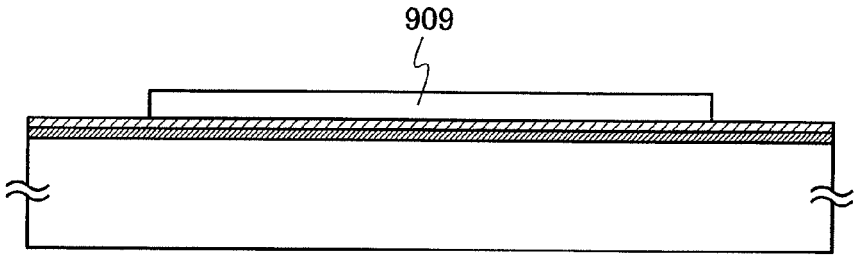

Next, as shown in FIG. 17B, by processing (patterning) the semiconductor film 908 into a desired shape, the island-shaped semiconductor film 909 is formed.

Figure 17C:
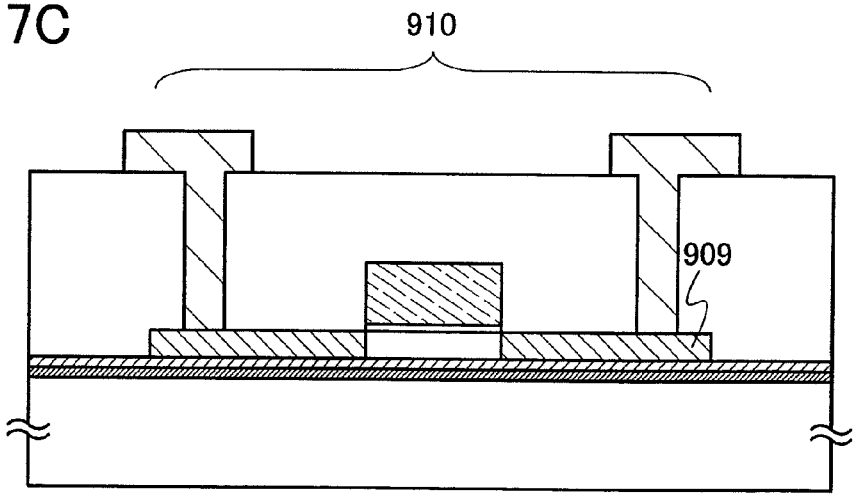

Various semiconductor elements such as transistors can be formed using the semiconductor film 909 formed through the above step. In FIG. 17C, a transistor 910 formed using the semiconductor film 909 is shown.

By using the above manufacturing method, a semiconductor element included in the light-emitting device that is one mode illustrated in this specification can be manufactured.

This embodiment can be combined with any of the embodiment modes as appropriate.

Embodiment 2

Figure 18A:
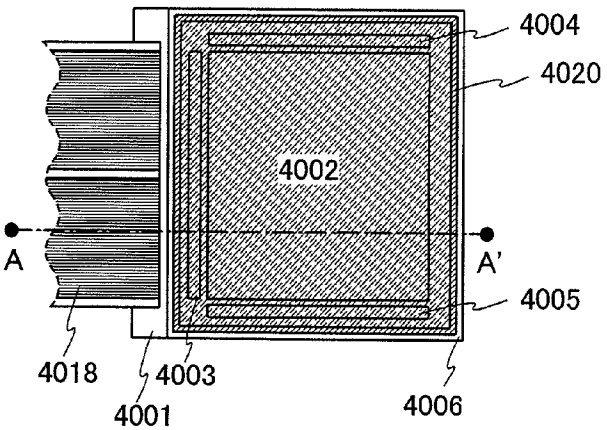
FIG. 18A is a top view of a light-emitting device.
Figure 18B:
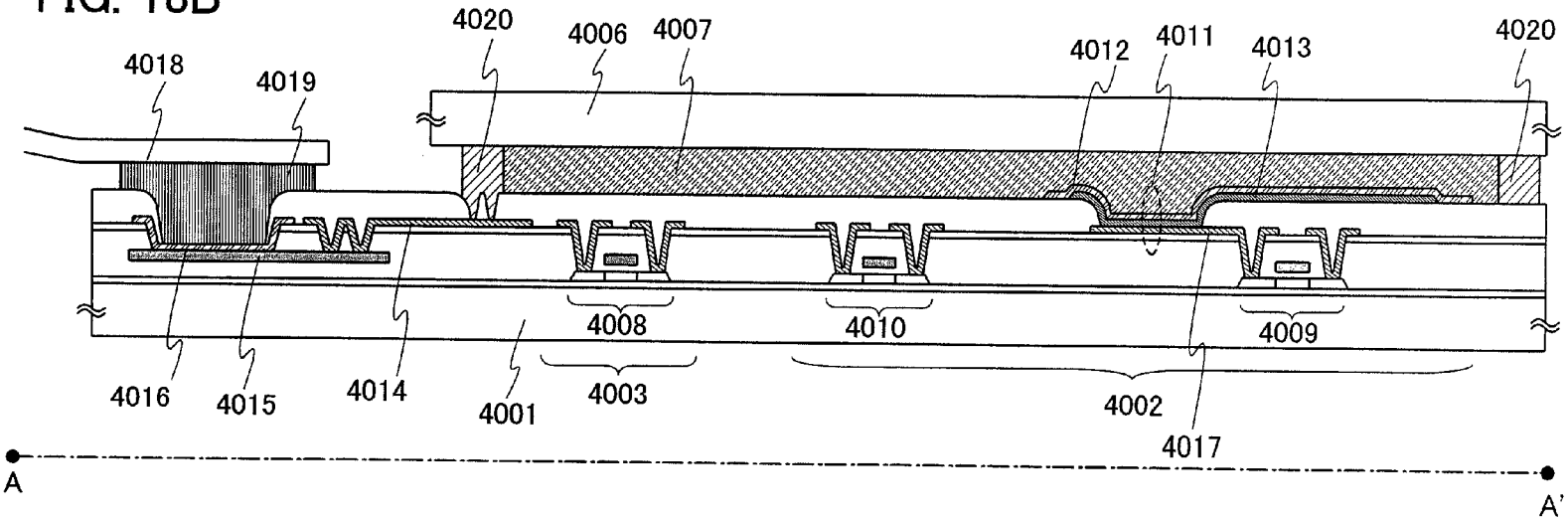
FIG. 18B is a cross-sectional view thereof.

In this embodiment, the appearance of a light-emitting device that is one mode illustrated in this specification is described with reference to FIGS. 18A and 18B. FIG. 18A is a top view of a panel in which a transistor and a light-emitting element which are formed over a first substrate are sealed between the first substrate and a second substrate with a sealant. FIG. 18B corresponds to a cross-sectional view taken along line A-A' in FIG. 18A.

A sealant 4020 is provided so as to surround a pixel portion 4002, a signal line driver circuit 4003, a scan line driver circuit 4004, a scan line driver circuit 4005 which are provided over a first substrate 4001. Further, a second substrate 4006 is provided over the pixel portion 4002, the signal line driver circuit 4003, the scan line driver circuit 4004, and the scan line driver circuit 4005. Thus, the pixel portion 4002, the signal line driver circuit 4003, the scan line driver circuit 4004, and the scan line driver circuit 4005 are sealed together with a filler 4007 between the first substrate 4001 and the second substrate 4006 with the sealant 4020.

Each of the pixel portion 4002, the signal line driver circuit 4003, the scan line driver circuit 4004, and the scan line driver circuit 4005 which are formed over the first substrate 4001 has a plurality of transistors. In FIG. 18B, a transistor 4008 included in the signal line driver circuit 4003, and a transistor 4009 and a transistor 4010 which are included in the pixel portion 4002 are shown.

In addition, part of a wiring 4017 which is connected to a source region or a drain region of the transistor 4009 is used as a pixel electrode of a light-emitting element 4011. Further, the light-emitting element 4011 includes a common electrode 4012 and an electroluminescent layer 4013 in addition to the pixel electrode. Note that the structure of the light-emitting element 4011 is not limited to the structure shown in this embodiment. Note that the structure of the light-emitting element 4011 is not limited to the structure shown in this embodiment. The structure of the light-emitting element 4011 can be changed as appropriate in accordance with the direction of light extracted from the light-emitting element 4011, polarity of the thin film transistor 4009, or the like.

Although a variety of signals and voltage supplied to the signal line driver circuit 4003, the scan line driver circuit 4004, the scan line driver circuit 4005, or the pixel portion 4002 are not shown in the cross-sectional view shown in FIG. 18B, the variety of signals and voltage are supplied from a connection terminal 4016 through lead wirings 4014 and 4015.

In this embodiment, the connection terminal 4016 is formed using the same conductive film as the common electrode 4012 included in the light-emitting element 4011. In addition, the lead wiring 4014 is formed using the same conductive film as the wiring 4017. Further, the lead wiring 4015 is formed using the same conductive film as gate electrodes of the transistor 4009, the transistor 4010, and the transistor 4008.

The connection terminal 4016 is electrically connected to a terminal of an FPC 4018 through an anisotropic conductive film 4019.

Note that for each of the first substrate 4001 and the second substrate 4006, glass, metal (typically stainless steel), ceramics, or plastics can be used. Note that the second substrate 4006 which is in a direction from which light from the light-emitting element 4011 is extracted needs to have a light-transmitting property. Thus, a light-transmitting material such as a glass plate, a plastic plate, a polyester film, or an acrylic film is preferably used for the second substrate 4006.

In addition, as well as inert gas such as nitrogen or argon, an ultraviolet curable resin or a thermosetting resin can be used for the filler 4007. In this embodiment, an example in which nitrogen is used for the filler 4007 is shown.

This embodiment can be combined with any of the embodiment modes and embodiments as appropriate.

Embodiment 3

In one mode illustrated in this specification, it is possible to provide a light-emitting device having a large screen, in which high-definition images can be displayed and power consumption can be reduced. Thus, a light-emitting device that is one mode illustrated in this specification is preferably used for display devices, laptops, or image reproducing devices provided with recording media (typically devices which reproduce the content of recording media such as DVDs (digital versatile disc) and have displays for displaying the reproduced images). Further, as electronic devices which can use the light-emitting device that is one mode illustrated in this specification, there are a cellular phone, a portable game machine, an e-book reader, a camera such as a video camera or a digital still camera, a goggle-type display (a head mounted display), a navigation system, and an audio reproducing device (e.g., a car audio or an audio component set). Specific examples of these electronic devices are shown in FIGS. 19A to 19C.

Figure 19A:
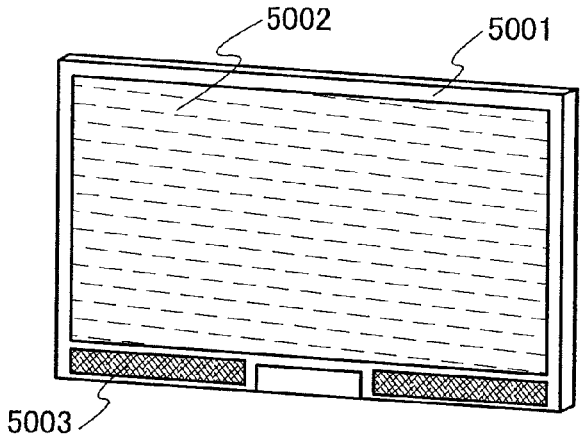
FIGS. 19A to 19C are diagrams of electronic devices each using a light-emitting device.

FIG. 19A shows a display device, which includes a housing 5001, a display portion 5002, a speaker portion 5003, and the like. The light-emitting device that is one mode illustrated in this specification can be used for the display portion 5002. Note that a display device includes all display devices for displaying information, such as display devices for personal computers, for receiving television broadcast, and for displaying advertisement, in its category.

Figure 19B:
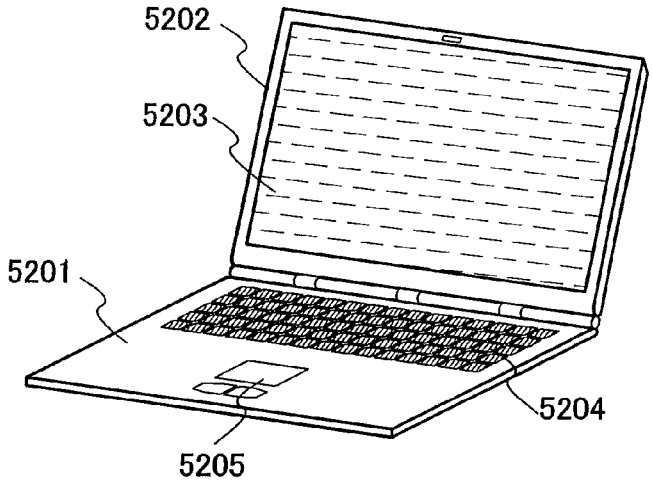

FIG. 19B shows a laptop, which includes a main body 5201, a housing 5202, a display portion 5203, a keyboard 5204, a mouse 5205, and the like. The light-emitting device that is one mode illustrated in this specification can be used for the display portion 5203.

Figure 19C:
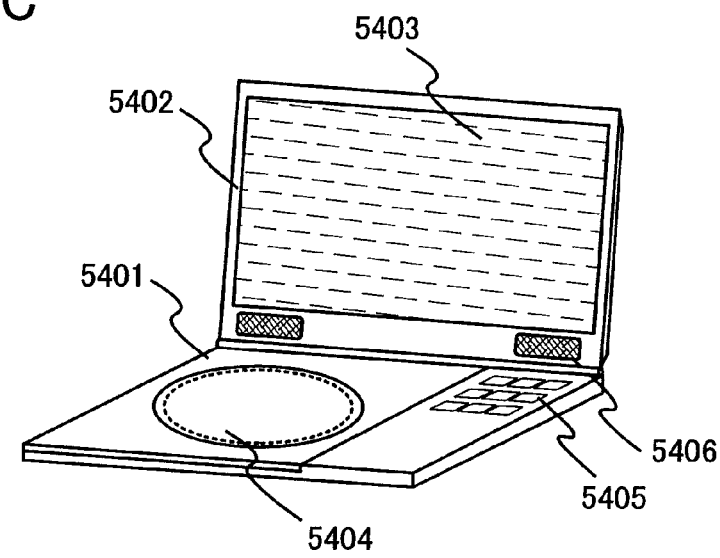

FIG. 19C shows a portable image reproducing device provided with a recording medium (specifically a DVD player), which includes a main body 5401, a housing 5402, a display portion 5403, a recording medium (e.g., a DVD) reading portion 5404, an operation key 5405, a speaker portion 5406, and the like. An image reproducing device provided with a recording medium includes a home-use game machine in its category. The light-emitting device that is one mode illustrated in this specification can be used for the display portion 5403.

As described above, the application range of the invention that is one mode illustrated in this specification is so wide that the invention that is one mode illustrated in this specification can be applied to electronic devices in all fields.

This embodiment can be combined with any of the embodiment modes and embodiments as appropriate.

This application is based on Japanese Patent Application serial no. 2008-005148 filed with Japan Patent Office on Jan. 15, 2008, the entire contents of which are hereby incorporated by reference.

The invention claimed is:

1. A light-emitting device comprising:

a light-emitting element;

a first power supply line having a first potential;

a second power supply line having a second potential;

a first transistor for controlling conduction between the first power supply line and the light-emitting element;

a second transistor for controlling whether the second potential applied from the second power supply line is outputted depending on a video signal inputted to a gate of the second transistor;

a switch for selecting either the first potential applied from the first power supply line or an output of the second transistor; and a third transistor for selecting whether either the first potential or the output of the second transistor selected by the switch is applied to a gate of the first transistor.

2. The light-emitting device according to claim 1, further comprising a capacitor, wherein one of electrodes of the capacitor is electrically connected to the gate of the first transistor, and the other of electrodes of the capacitor is electrically connected to the first power supply line.

3. The light-emitting device according to claim 1, wherein the light-emitting element comprises an electroluminescence layer.

4. A light-emitting device according to claim 1, wherein the switch includes a fourth transistor for selecting the first potential applied from the first power supply line and a fifth transistor for selecting the second potential applied from the second power supply line through the second transistor.

5. The light-emitting device according to claim 4, wherein polarity of the fourth transistor is different from polarity of the fifth transistor, and wherein a gate of the fourth transistor and a gate of the fifth transistor are electrically connected to each other.

6. The light-emitting device according to claim 5, wherein the first transistor and the fourth transistor are p-channel transistors, and the second transistor and the fifth transistor are n-channel transistors.

7. A light-emitting device comprising a plurality of pixels sharing a first scan line and a second scan line, wherein each of the plurality of pixels includes a light-emitting element, a first power supply line having a first potential, a second power supply line having a second potential, a first transistor for controlling conduction between the first power supply line and the light-emitting element, a second transistor for controlling whether the second potential applied form the second power supply line is outputted depending on a video signal inputted to a gate of the second transistor, a switch for selecting either the first potential applied from the first power supply line or an output of the second transistor in accordance with a potential of the first scan line, and a third transistor for selecting whether either the first potential or the output of the second transistor selected by the switch is applied to a gate of the first transistor.

8. The light-emitting device according to claim 7,
wherein each of the plurality of pixels further comprises a capacitor, and
wherein one of electrodes of the capacitor is electrically connected to the gate of the first transistor, and the other of electrodes of the capacitor is electrically connected to the first power supply line.

9. The light-emitting device according to claim 7,
wherein the light-emitting element comprises an electroluminescence layer.

10. The light-emitting device according to claim 7,
wherein the switch includes a fourth transistor for selecting the first potential applied from the first power supply line and a fifth transistor for selecting the second potential applied from the second power supply line through the second transistor.

11. The light-emitting device according to claim 10,
wherein polarity of the fourth transistor is different from polarity of the fifth transistor, and
wherein a gate of the fourth transistor and a gate of the fifth transistor are electrically connected to the second scan line.

12. The light-emitting device according to claim 11,
wherein the first transistor and the fourth transistor are p-channel transistors, and the second transistor and the fifth transistor are n-channel transistors.

13. A light-emitting device comprising:
a light-emitting element;
a first transistor;
a second transistor;
a third transistor;
a fourth transistor; and
a fifth transistor,
wherein one of a source and a drain of the first transistor is electrically connected to the light-emitting element,
wherein the other of the source and the drain of the first transistor is electrically connected to a first wiring;
wherein a gate of the first transistor is electrically connected to one of a source and a drain of the second transistor,
wherein the other of the source and the drain of the second transistor is electrically connected to one of a source and a drain of the third transistor and one of a source and a drain of the fourth transistor,
wherein the other of the source and the drain of the third transistor is electrically connected to the first wiring,
wherein the other of the source and the drain of the fourth transistor is electrically connected to one of a source and a drain of the fifth transistor,
wherein the other of the source and the drain of the fifth transistor is electrically connected to a second wiring, and
wherein a gate of the fifth transistor is electrically connected to a third wiring.

14. The light-emitting device according to claim 13,
wherein the third wiring is a video signal line.

15. The light-emitting device according to claim 13,
wherein the first wiring and the second wiring are power supply lines.

16. The light-emitting device according to claim 13, further comprising a capacitor,
wherein one of electrodes of the capacitor is electrically connected to the gate of the first transistor, and the other of electrodes of the capacitor is electrically connected to the first wiring.

17. The light-emitting device according to claim 13,
wherein the light-emitting element comprises an electroluminescence layer.

18. The light-emitting device according to claim 13,
wherein a gate of the third transistor and a gate of the fourth transistor are electrically connected to a fourth wiring, and
wherein polarity of the third transistor is different from polarity of the fourth transistor.

19. The light-emitting device according to claim 18,
wherein the first transistor and the third transistor are p-channel transistors, and the fourth transistor and the fifth transistor are n-channel transistors.

* * * * *

UNITED STATES PATENT AND TRADEMARK OFFICE

CERTIFICATE OF CORRECTION

PATENT NO. : 8,044,598 B2
APPLICATION NO. : 12/352688
DATED : October 25, 2011
INVENTOR(S) : Ryota Fukumoto et al.

It is certified that error appears in the above-identified patent and that said Letters Patent is hereby corrected as shown below:

In the Specification:

Column 5, Line 58; Change “U” to --(j--

In the Claims:

Column 30, Line 59, Claim 7; Change “form” to --from--

Signed and Sealed this
Fifteenth Day of January, 2013

David J. Kappos

David J. Kappos
*Director of the United States Patent and Trademark Office*